US011504876B2

(12) United States Patent
Zhao et al.

(10) Patent No.: US 11,504,876 B2
(45) Date of Patent: Nov. 22, 2022

(54) THICKNESS PLANER

(71) Applicant: MAKITA CORPORATION, Anjo (JP)

(72) Inventors: Zuoxiu Zhao, Jiangsu (CN); Shixuan Peng, Jiangsu (CN); Pengsheng Wang, Jiangsu (CN); Xiongfei Wen, Jiangsu (CN)

(73) Assignee: MAKITA CORPORATION, Anjo (JP)

( * ) Notice: Subject to any disclaimer, the term of this patent is extended or adjusted under 35 U.S.C. 154(b) by 240 days.

(21) Appl. No.: 16/929,332

(22) Filed: Jul. 15, 2020

(65) Prior Publication Data

US 2021/0016463 A1 Jan. 21, 2021

(30) Foreign Application Priority Data

Jul. 15, 2019 (CN) ..... 201910633904.0

(51) Int. Cl.

| | |
|---|---|
| ***B27C 1/04*** | (2006.01) |
| ***B27G 3/00*** | (2006.01) |
| ***B27C 1/14*** | (2006.01) |

(52) U.S. Cl.

CPC ..... *B27C 1/04* (2013.01); *B27C 1/14* (2013.01); *B27G 3/00* (2013.01)

(58) Field of Classification Search

USPC ..... 144/114.1

See application file for complete search history.

(56) References Cited

U.S. PATENT DOCUMENTS 2,672,172 A * 3/1954 Godfrey ..... B27C 1/10 30/475
4,601,104 A * 7/1986 Zaiser ..... B27C 1/10 30/475
6,148,879 A * 11/2000 Liao ..... B23Q 11/0046 409/137
7,705,497 B2 * 4/2010 Arich ..... B25D 16/00 310/58
9,808,872 B2 * 11/2017 Yamaguchi ..... B25F 5/008

(Continued)

FOREIGN PATENT DOCUMENTS

CN 1753768 A 3/2006
CN 103659459 A * 3/2014 ..... B23D 47/00

(Continued)

OTHER PUBLICATIONS

Apr. 18, 2022 Office Action issued in Chinese Patent Application No. 201910633904.0.

*Primary Examiner* — Jessica Cahill
*Assistant Examiner* — Smith Oberto Bapthelus
(74) *Attorney, Agent, or Firm* — Oliff PLC

(57) ABSTRACT

A thickness planer has a housing, a motor housed in the housing, a controller having a control board configured to control driving of the motor, at least one intake port provided in the housing, at least one outlet port provided in the housing, an air flow passage that is provided within the housing and configured such that air taken in from the at least one intake port flows therethrough toward the at least one outlet port via the motor, and a fan that is configured to generate flow of air from the at least one intake port to the at least one outlet port through the air flow passage. A particular region of the controller is arranged on the air flow passage.

10 Claims, 18 Drawing Sheets

(56) References Cited

U.S. PATENT DOCUMENTS

| | | | | |
|---|---|---|---|---|
| 2003/0188803 | A1* | 10/2003 | Liao | B27C 1/14 144/252.1 |
| 2003/0205293 | A1* | 11/2003 | Gilbert | B27C 1/12 144/357 |
| 2004/0112464 | A1* | 6/2004 | Chiang | B27C 1/14 144/130 |
| 2007/0033807 | A1 | 2/2007 | Wanninkhof | |
| 2009/0020184 | A1* | 1/2009 | Merhar | B23Q 16/001 15/300.1 |
| 2014/0084718 | A1 | 3/2014 | Naito et al. | |
| 2014/0331508 | A1* | 11/2014 | Simm | B25F 5/008 30/475 |
| 2015/0026985 | A1* | 1/2015 | Yamaguchi | B23D 45/16 30/123 |
| 2015/0183125 | A1* | 7/2015 | Kumakura | B25F 5/008 30/475 |
| 2018/0169885 | A1* | 6/2018 | Okouchi | B26D 1/14 |

FOREIGN PATENT DOCUMENTS

| | | | | |
|---|---|---|---|---|
| CN | 104742197 | A | 7/2015 | |
| CN | 109093863 | A | 12/2018 | |
| DE | 102013208705 | A1 * | 11/2014 | B25F 5/008 |
| JP | H11-198104 | A | 7/1999 | |
| JP | 4165917 | B2 | 10/2008 | |

* cited by examiner

THICKNESS PLANER

CROSS-REFERENCE TO RELATED APPLICATION

The present application claims priority to Chinese patent application No. 2019 1063 3904.0 filed on Jul. 15, 2019, the contents of which are fully incorporated herein by reference.

TECHNICAL FIELD

The present invention relates to a thickness planer.

BACKGROUND ART

Japanese Patent No. 4165917 discloses a thickness planer having a motor which is controlled by a controller.

SUMMARY

According to one aspect of the present invention, a thickness planer configured to plane a workpiece by a driving force of a motor is provided. The thickness planer has a housing, a motor housed in the housing, a controller having a control board configured to control driving of the motor, at least one intake port provided in the housing, at least one outlet port provided in the housing, an air flow passage and a fan. The air flow passage is provided within the housing and configured such that air taken in from the at least one intake port flows therethrough toward the at least one outlet port via the motor. The fan is configured to generate flow of air from the at least one intake port to the at least one outlet port through the air flow passage. In the thickness planer of this aspect, a particular region of the controller is arranged on the air flow passage.

DETAILED DESCRIPTION OF THE EMBODIMENTS

First Embodiment

Figure 1:
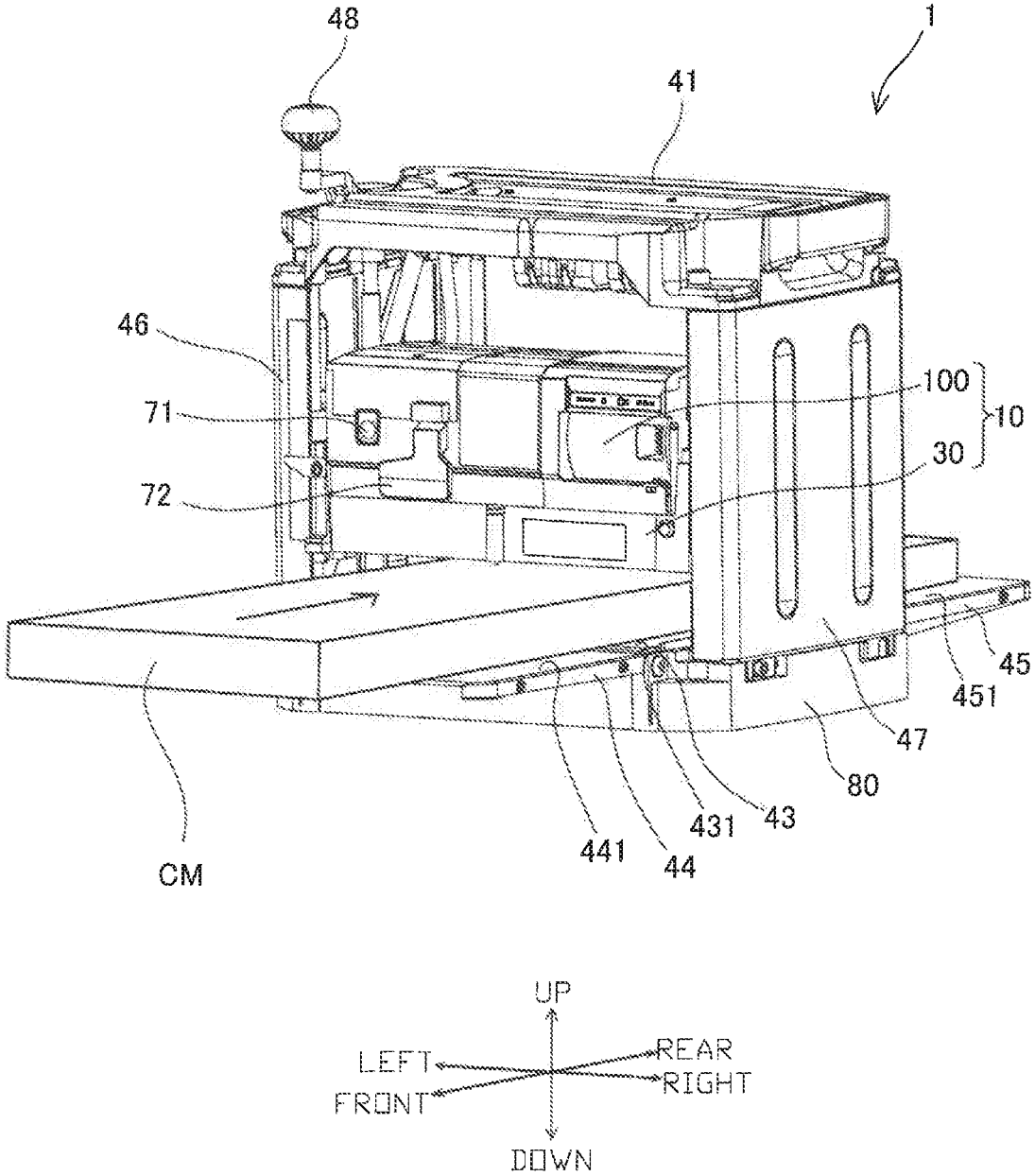
FIG. 1 is a front perspective view of a thickness planer.

The structure of a thickness planer 1 is briefly described as an embodiment of the present disclosure with reference to FIGS. 1 to 5.

The thickness planer 1 is configured to feed a workpiece (material to be planed) CM placed on a placing surface 431 of a table 43 to a cutting area (planing area) CA and plane an upper surface of the workpiece CM passing through the cutting area CA. In this embodiment, the thickness planer 1 feeds the workpiece CM placed on the table 43 in a feeding direction shown by an arrow in FIG. 1.

In the following description, for convenience sake, the feeding direction is defined as a front-rear direction, and in the front-rear direction, the side of the thickness planer 1 to which the workpiece CM is fed is defined as a rear side and the opposite side is defined as a front side. Specifically, the workpiece CM is fed from the front side to the rear side of the thickness planer 1. Further, a direction perpendicular to the placing surface 431 of the table 43 on which the workpiece CM is placed is defined as a vertical direction. In the vertical direction, a direction from the table 43 toward the workpiece CM is defined as an upper direction and the opposite direction is defined as a lower direction. Further, a direction perpendicular to the front-rear direction and the vertical direction is defined as a left-right direction. In the left-right direction, a left and right sides in the feeding direction are respectively defined as a left side and a right side.

As shown in the drawings, the thickness planer 1 has a body unit 10 having a cutting (planing) function. A top cover 41 is arranged above the body unit 10 and a base 80 is arranged below the body unit 10. The table 43 is arranged on an upper side of the base 80. Further, a left side cover 46 and a right side cover 47 are arranged on left and right sides of the body unit 10, respectively.

A lifting handle 48 is provided on the top cover 41 and configured to be rotatable around a rotation axis extending in the vertical direction. The body unit 10 is configured to be raised and lowered in the vertical direction with respect to the table 43 by user's operation of turning the lifting handle 48. The vertical length of the cutting area CA which is surrounded by the body unit 10, the table 43, the left side cover 46 and the right side cover 47 can be adjusted by raising and lowering the body unit 10. The thickness planer 1 is configured to be capable of planing the workpiece CM of different thicknesses by adjusting the vertical length of the cutting area CA according to the thickness (vertical length) of the workpiece CM.

A front auxiliary table 44 is pivotally supported around a pivot axis extending in the left-right direction on a front end of the table 43. Further, a rear auxiliary table 45 is pivotally supported around a pivot axis extending in the left-right direction on a rear end of the table 43. The front auxiliary table 44 and the rear auxiliary table 45 have respectively a placing surface 441 and a placing surface 451 on which the workpiece CM can be placed. The placing surfaces 441, 431, 451 are configured to be flush with each other when the front and rear auxiliary tables 44, 45 are placed in a horizontal state (unfolded or open state). When turned upward around the pivot axis, the front and rear auxiliary tables 44, 45 are folded (closed) upward from the front and rear ends of the table 43.

Figure 2:
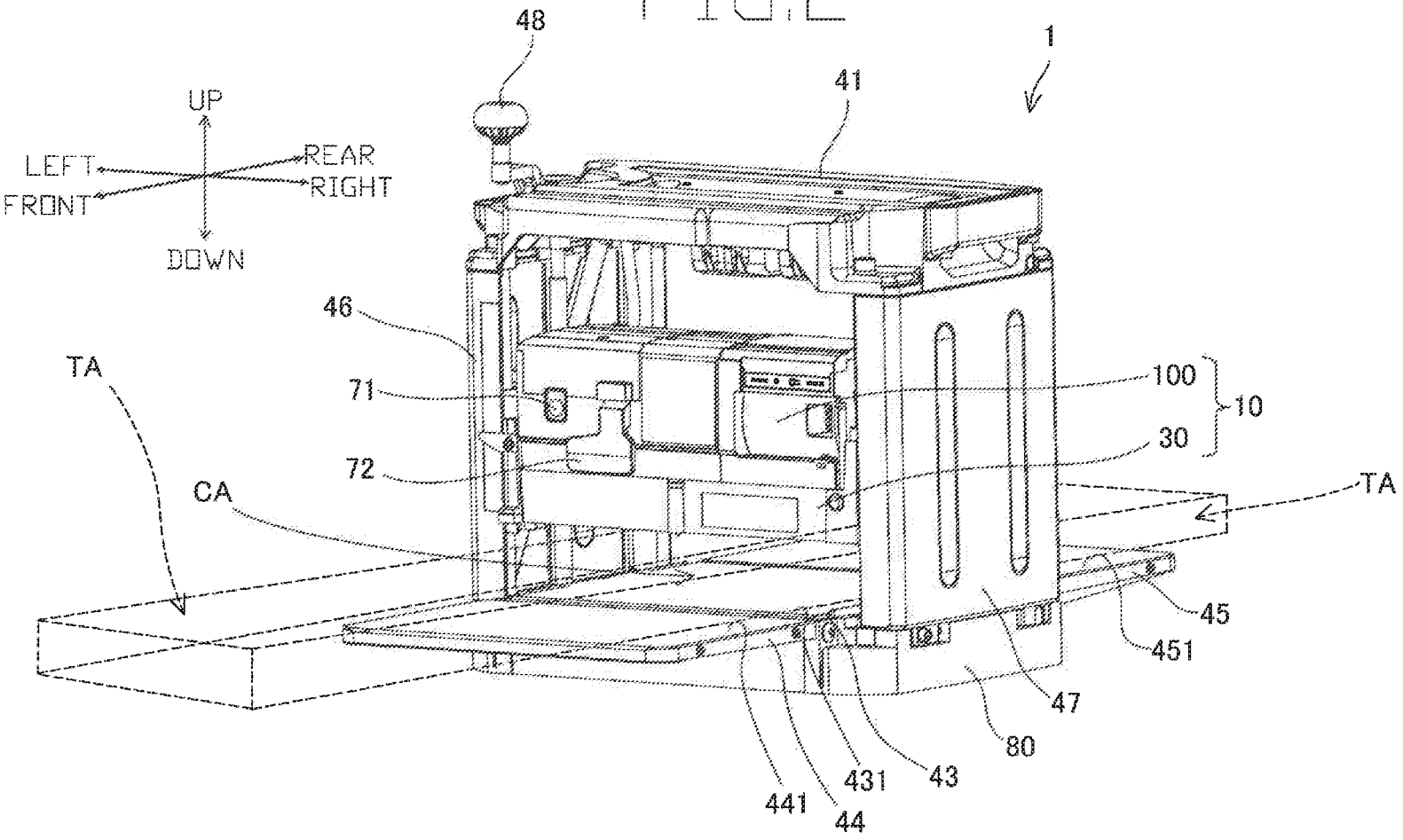
FIG. 2 is a perspective view for showing a feeding area of the thickness planer.
Figure 3:
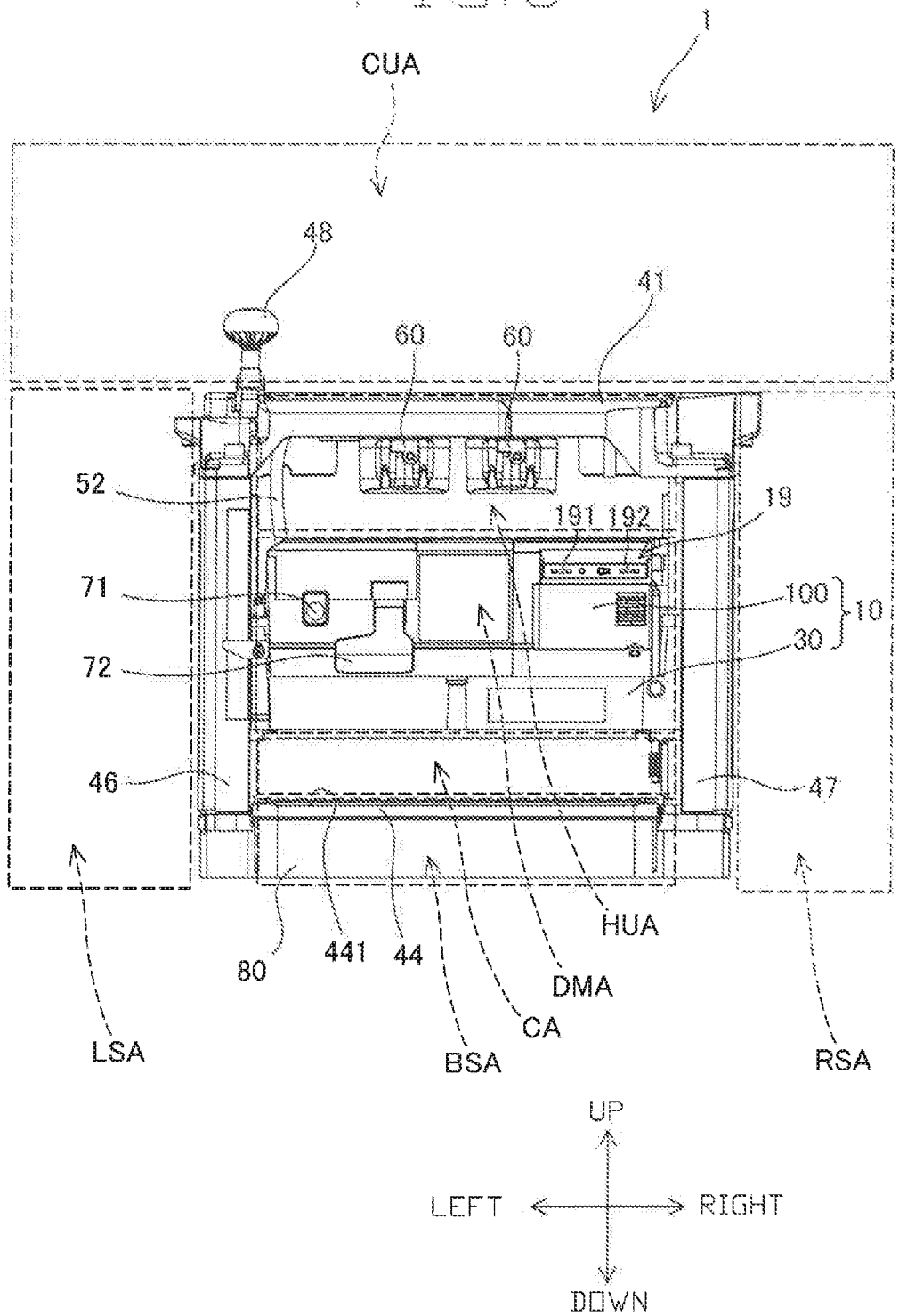
FIG. 3 is a front view of the thickness planer.

As described above, an area which is surrounded by the body unit 10, the table 43, the left side cover 46 and the right side cover 47 is defined as the cutting area (planing area) CA. Further, as shown in FIG. 2, an area through which the workpiece CM passes while being fed is defined as a feeding area TA. Furthermore, as shown in FIG. 3, an area above the top cover 41 including the lifting handle 48 is defined as a cover upper area CUA. An area above an upper end of a main housing 100 is defined as a housing upper area HUA. An area extending from a lower end of a main frame 30 of the body unit 10 to the upper end of the main housing 100 is defined as a driving mechanism arrangement area DMA. An area below the placing surface 431 of the table 43 is defined as a base area BSA. An area extending on the left side of the left side cover 46 is defined as a left side area LSA. An area extending on the right side of the right side cover 47 is defined as a right side area RSA.

In this embodiment, a battery pack mounting unit 50 is mounted in an area above the main housing 100 and below the top cover 41. In other words, the battery pack mounting unit 50 is mounted in the housing upper area HUA. Specifically, the battery pack mounting unit 50 is fastened to a lower surface of the top cover 41 by a plurality of screw parts. The battery pack mounting unit 50 is configured to be mounted such that two battery packs 60 is removably attached thereto. The battery packs 60 are attached and detached by being slid with respect to the battery pack mounting unit 50.

Figure 4:
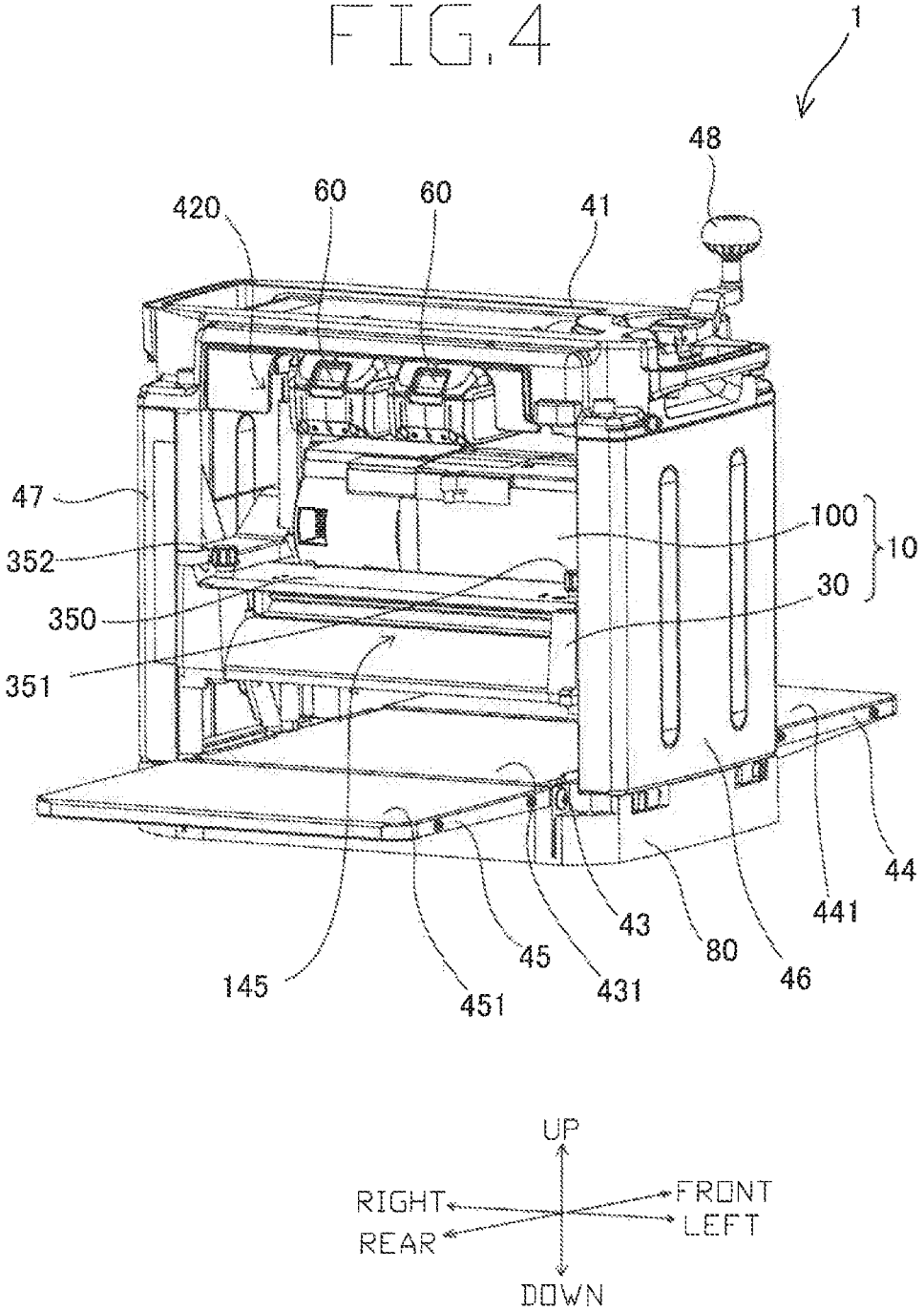
FIG. 4 is a rear perspective view of the thickness planer.
Figure 5:
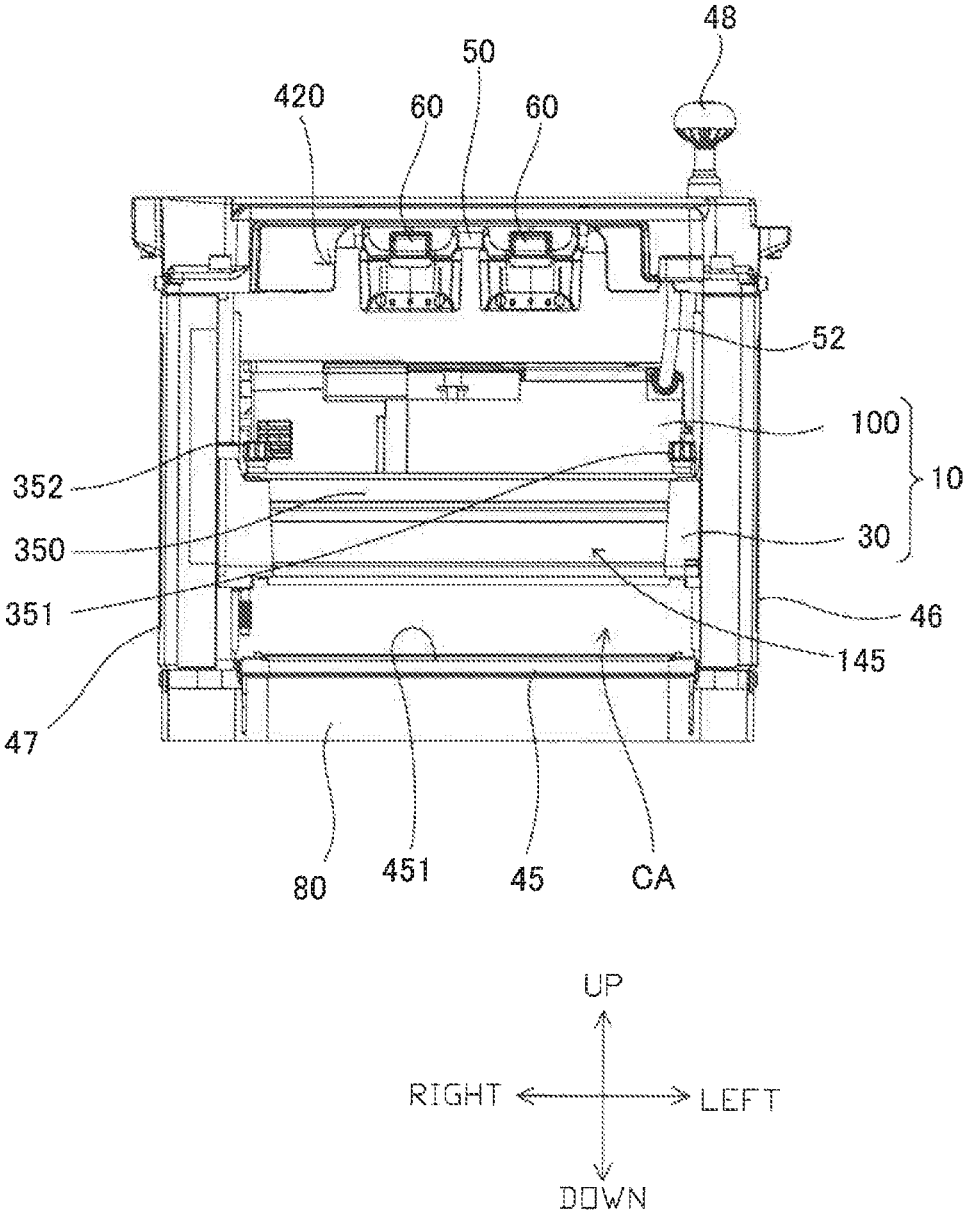
FIG. 5 is a rear view of the thickness planer.

As shown in FIGS. 4 and 5, the battery packs 60 are attached and detached by being slid in the front-rear direction with respect to the battery pack mounting unit 50 from the rear of the thickness planer 1. An arch-shaped escape part 420 is formed in a rear part of the top cover 41 and facilitates user's operation of attaching and detaching the battery pack 60.

The battery pack mounting unit 50 and the body unit 10 are electrically connected to each other by an electric cord 52. The thickness planer 1 in this embodiment has the rated voltage of 36 volts. The battery packs 60 each having a nominal voltage of 18 volts are electrically connected in series and attached to the battery pack mounting unit 50. The thickness planer 1 is driven by power supply from the battery packs 60 attached to the battery pack mounting unit 50. The battery pack mounting unit 50 and the battery pack 60 will be described below in detail.

As shown in FIG. 3, the body unit 10 includes the main housing 100 and the main frame 30. On the main housing 100, a residual capacity display part 19 is provided to display a battery residual capacity of each of the battery packs 60 attached to the battery pack mounting unit 50. The residual capacity display part 19 is provided with two residual capacity gauges 191 and 192. The residual capacity gauges 191 and 192 respectively display battery residual capacities of the two battery packs 60 attached to the battery pack mounting unit 50. The residual capacity gauge 191 has three LED lamps arranged in a row in the left-right direction. When the battery pack 60 associated with the residual capacity gauge 191 is fully charged, all of the three LED lamps illuminate. The three LED lamps are sequentially turned off as the battery residual capacity of the battery pack 60 decreases. The structure of the residual capacity gauge 192 has the same structure as the residual capacity gauge 191 and is not therefore described here.

Further, a main switch 71 and a lever switch 72 are provided on the main housing 100. When the main switch 71 is turned on, power is supplied up to the lever switch 72 in an electrical circuit from the battery packs 60 attached to the battery pack mounting unit 50 to a motor 15 described below. When the lever switch 72 is turned on while the main switch 71 is kept on, power is supplied to the motor 15 and the motor 15 starts rotating. Thus, the thickness planer 1 comes into a driven state ready for planing the workpiece CM.

The main switch 71 is a push-button alternate switch. Once pressed in the off state, the main switch 71 is turned on and kept in the on state, while once pressed in the on state, the main switch 71 is turned off and kept in the off state.

The lever switch 72 is pivotally supported around a pivot axis extending in the left-right direction by the main housing 100. When the lever switch 72 in the off state is turned upward by a prescribed angle around the pivot axis, the lever switch 72 is turned on and kept in the on state, while, when the lever switch 72 in the on state is turned downward around the pivot axis and returned to an initial position, the lever switch 72 is turned off and kept in the off state. In the thickness planer 1 shown in FIGS. 1 to 5, the lever switch 72 is in the off state. In the thickness planer 1 of this embodiment, the main switch 71 and the lever switch 72 are arranged adjacent to each other so as to provide ease of operation for a user.

When the workpiece CM is fed to the cutting area CA while the main switch 71 and the lever switch 72 are in the on state and the thickness planer 1 is driven, the thickness planer 1 planes the workpiece CM. Shavings generated when the thickness planer 1 planes the workpiece CM are discharged from a chip discharge port 145 provided in a rear part of the body unit 10. An air is jetted from the chip discharge port 145 and blows off the shavings discharged from the chip discharge port 145, thereby preventing the shavings from being accumulated in the vicinity of the chip discharge port 145. Further, a plate-like chip cover 350 is fastened to the main frame 30 above the chip discharge port 145 by screw parts 351, 352. The chip cover 350 prevents the scattering of the shavings discharged from the chip discharge port 145.

The detailed structure of the thickness planer 1 is now described with reference to FIGS. 6 to 10.

Figure 6:
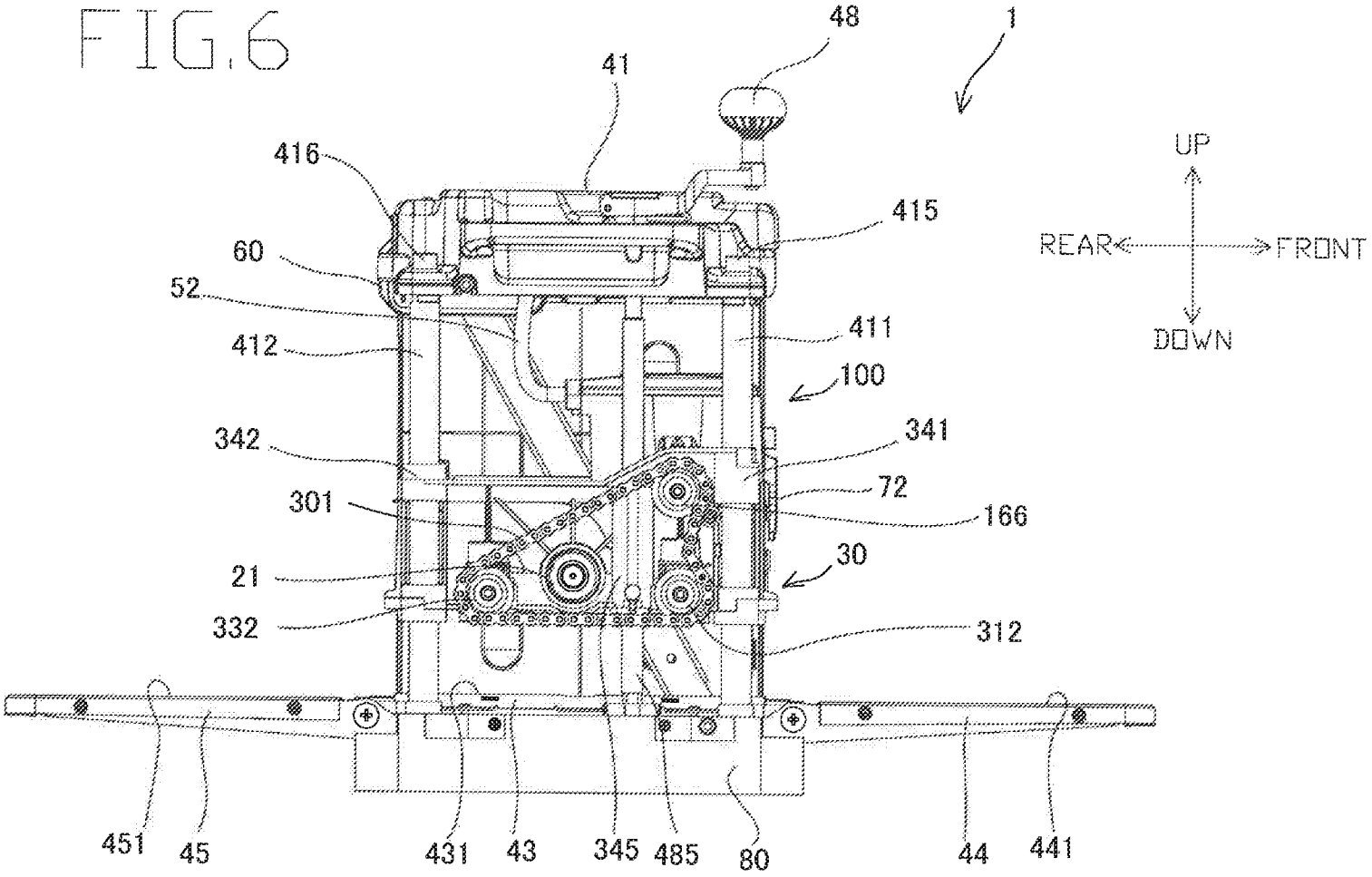
FIG. 6 is a left side view of the thickness planer with a left side cover removed.
Figure 7:
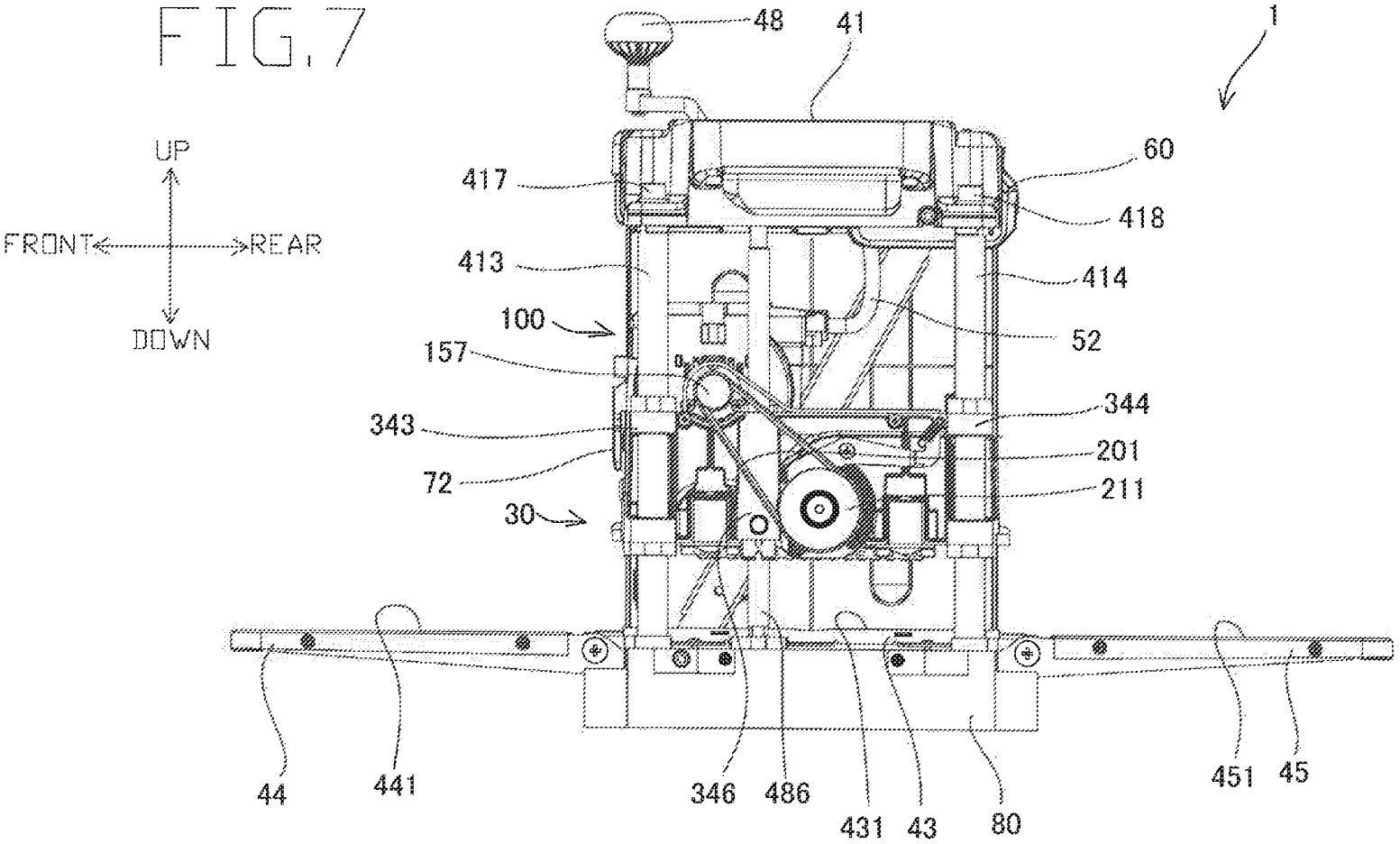
FIG. 7 is a right side view of the thickness planer with a right side cover removed.
Figure 8:
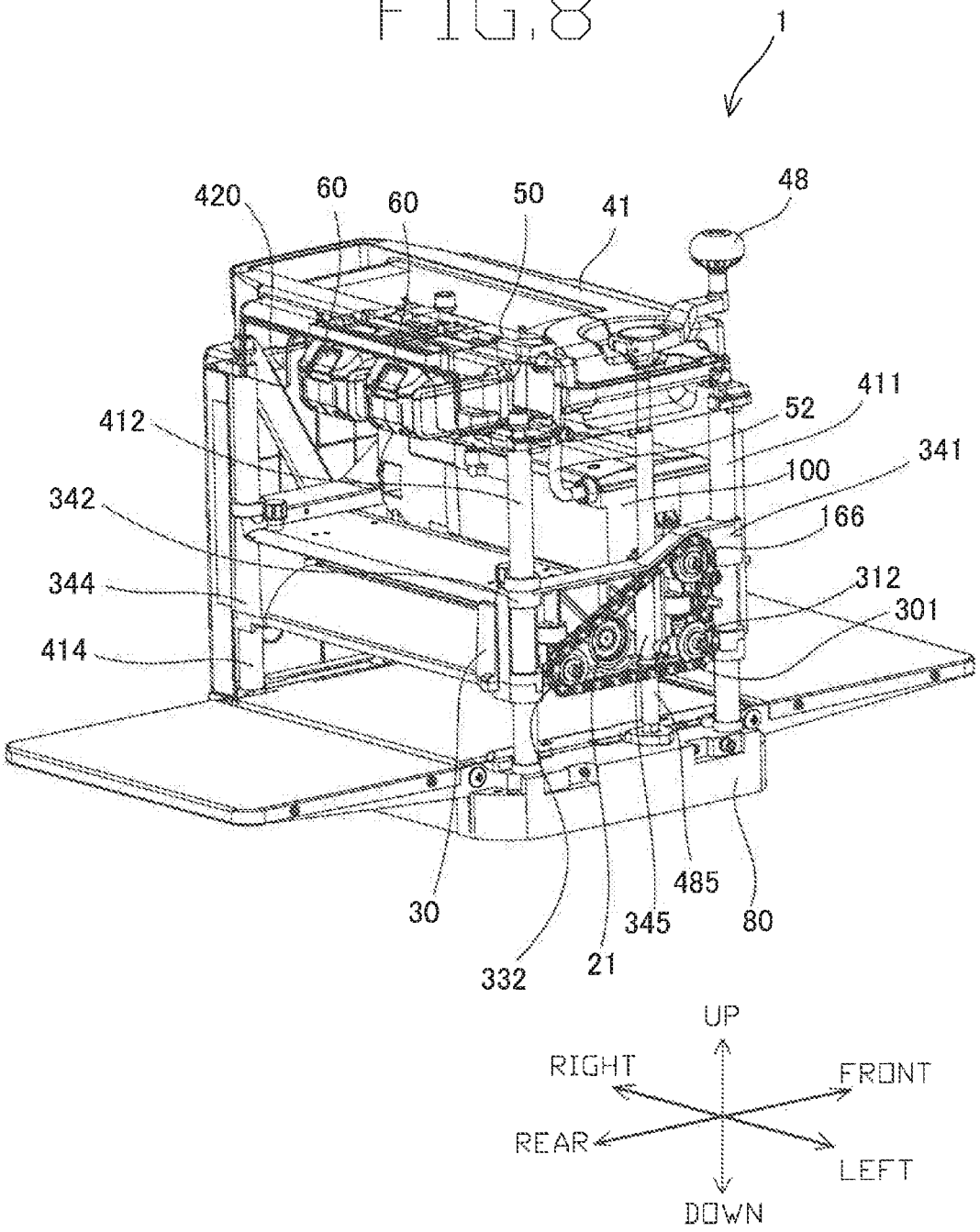
FIG. 8 shows the arrangement position of a battery pack mounting unit.

As shown in FIGS. 6 to 8, columns 411, 412, 413, 414 are erected vertically to the placing surface 431 in four corners of the base 80. Upper ends of the columns 411, 412, 413, 414 are fastened to the top cover 41 by screw parts 415, 416, 417, 418, respectively. Further, sliding parts 341, 342, 343, 344 are respectively provided on four corners of the main frame 30 and slidable in the vertical direction with respect to the columns 411, 412, 413, 414. The sliding parts 341, 342, 343, 344 have respective through holes through which the columns 411, 412, 413, 414 are respectively slidably inserted.

On left and right end parts of the base 80, lifting screw shafts 485, 486 are erected vertically to the placing surface 431 so as to be rotatable via respective bearing members provided on the placing surface 431. Lower end parts of the lifting screw shafts 485, 486 both protrude downward from the base 80. A space (lower side area) is formed on the lower side of the base 80. The lifting shaft (not shown) which is a rotation axis extending in the left-right direction is arranged in the lower side area of the base 80. The lifting shaft connects the lower end parts of the lifting screw shafts 485, 486. The lifting shaft is provided to synchronize rotation of the lifting screw shaft 485 and rotation of the lifting screw shaft 486. The lifting shaft converts rotation of the lifting screw shaft 485 around a rotation axis extending in the vertical direction into rotation around a rotation axis extending in the left-right direction and further converts this rotation into rotation around a rotation axis extending in the vertical direction, thereby rotating the lifting screw shaft 486.

Lifting screw hole parts 345, 346 are provided in left and right end parts of the main frame 30. The lifting screw hole parts 345, 346 have respective through holes extending therethrough in the vertical direction and the lifting screw shafts 485, 486 are rotatably threadedly engaged with the through holes, respectively. As shown in FIG. 8, an upper end part of the lifting screw shaft 485 extends through the top cover 41 and is connected to the lifting handle 48. When the lifting handle 48 is turned by a user, the lifting screw shaft 485 rotates together with the lifting handle 48. Further, the lifting screw shaft 486 rotates in synchronization with the rotation of the lifting screw shaft 485. When the lifting screw shafts 485, 486 are rotated, the lifting screw hole parts 345, 346 receive force in an upward or downward direction from the lifting screw shafts 485, 486 and thus the main frame 30 slides upward or downward. By upward or downward slide of the main frame 30, the body unit 10 slides upward or downward, so that the length of the cutting area CA in the vertical direction is changed. In this manner, the length of the cutting area CA in the vertical direction is changed by user's operation of rotating the lifting handle 48.

Next, the body unit 10 is described in detail.

Figure 9:
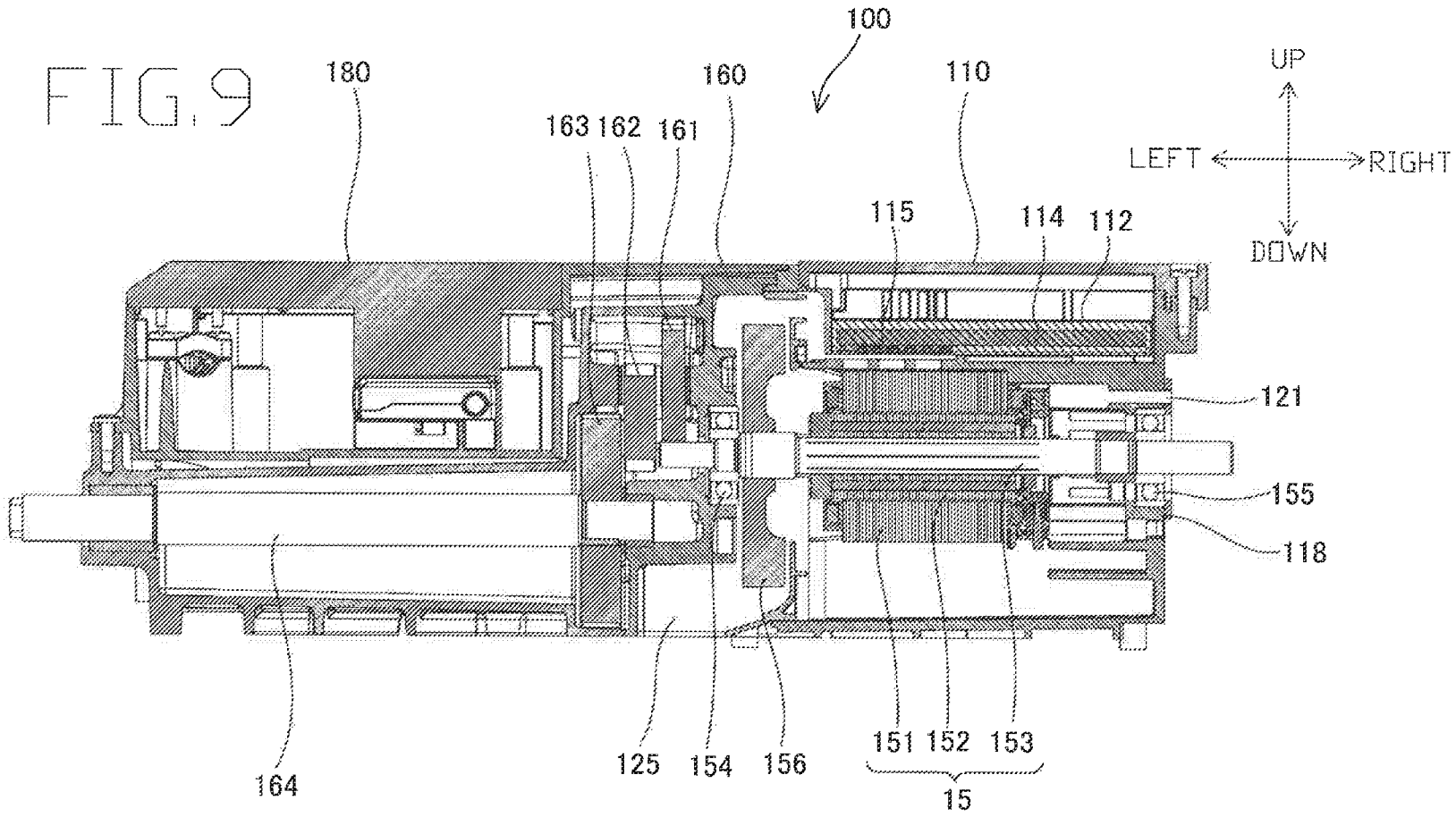
FIG. 9 shows the internal structure of a main housing.

As shown in FIG. 9, the main housing 10 has a first housing 110, a second housing 160 and a third housing 180. The motor 15 and a controller 112 are housed in the first housing 110. The controller 112 has a control board 114 for controlling driving of the motor 15. The control board 114 has a transistor 115 for switching the current flowing to the motor 15. In this embodiment, an FET (Field Effect Transistor) is adopted as the transistor 115. The control board 114 controls driving of the motor 15 by PWM (Pulse Width Modulation) control using the transistor 115.

The motor 15 is disposed below the controller 112. In this embodiment, a brushless motor having a stator 151, a rotor 152 and a motor shaft 153 extending from the rotor 152 is adopted as the motor 15. The motor shaft 153 extending in the left-right direction is rotatably supported at its left and right end parts by bearings 154, 155. In this embodiment, when the motor 15 and the bearing 155 are assembled into the first housing 110, the motor shaft 153 is inserted into the first housing 110 from the outside of a right end wall part 118 of the first housing 110. After the motor shaft 153 is inserted into the first housing 110, the bearing 155 is mounted to the first housing 110 from the outside of the right end wall part 118 so as to journal the motor shaft 153.

A fan 156 is provided onto the motor shaft 153 between the bearing 154 and the rotor 152. The fan 156 rotates together with the motor shaft 153 around a rotation axis of the motor shaft 153. The main housing 100 has an intake port 121 and an outlet port 125. Further, an air flow passage is formed in the main housing 100 to provide communication between the intake port 121 and the outlet port 125. The fan 156 generates flow of air from the intake port 121 to the outlet port 125 through the air flow passage. The air flowing through the air flow passage cools the motor 15 and the controller 112.

Figure 10:
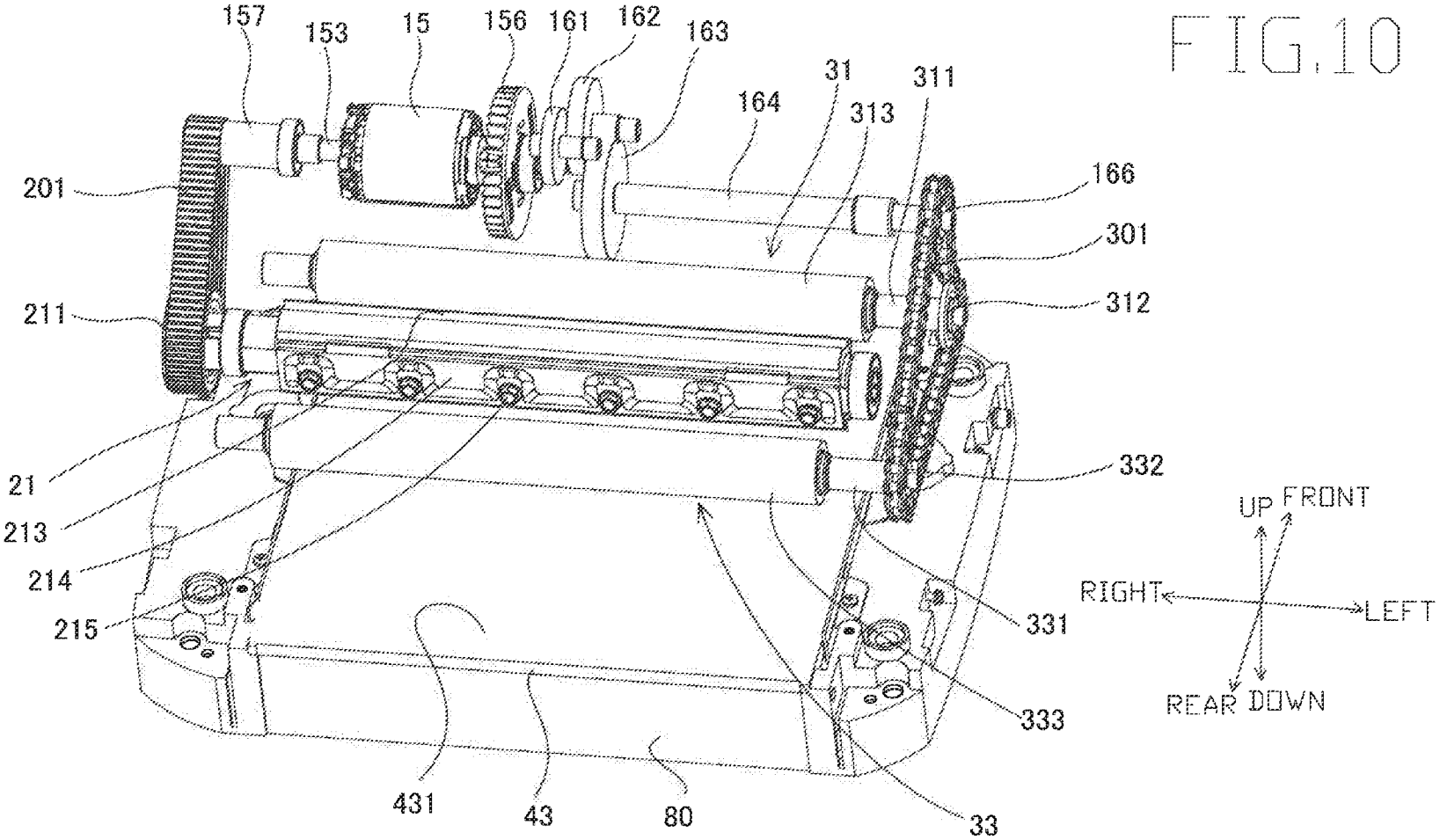
FIG. 10 is an explanatory drawing showing a driving mechanism of the thickness planer.

Gears 161, 162, 163 are housed in the second housing 160. Each of the three gears 161, 162, 163 is configured to be rotatable around a rotation axis parallel to the rotation axis of the motor shaft 153. A left end part of the motor shaft 153 protrudes into the second housing 160 and the gear 161 is engaged with this protruding part. The gear 161 engages with the gear 162 and the gear 162 engages with the gear 163. A drive shaft 164 is housed in the third housing 180 and a right end part of the drive shaft 164 is integrally connected to the gear 163. The drive shaft 164 is configured to be rotatable around a rotation axis parallel to the rotation axis of the motor shaft 153. The drive shaft 164 rotates together with the gear 163. Rotational power (speed) of the motor 15 is appropriately changed via the gears 161, 162, 163 and then transmitted to the drive shaft 164. As shown in FIG. 10, a gear 166 is connected to a left end part of the drive shaft 164 and rotates together with the drive shaft 164. A chain 301 is looped over the gear 166. Feed rollers 31, 33 are housed in the main frame 30. The chain 301 is looped over a gear 312 of the feed roller 31 and a gear 332 of the feed roller 33. Rotational power of the drive shaft 164 is transmitted to the feed roller 31 via the gear 166, the chain 301 and the gear 312 and also transmitted to the feed roller 33 via the gear 166, the chain 301 and the gear 332.

As shown in FIG. 10, a cutter head 21 for planing the workpiece CM and the feed rollers 31, 33 for feeding the workpiece CM are disposed in the main frame 30. The feed roller 31 is disposed in front of the cutter head 21 and the feed roller 33 is disposed behind the cutter head 21. The feed roller 31 has a shaft 311, a gear 312 and a roller part 313. The shaft 311 is configured to be rotatable around a rotation axis extending in the left-right direction. The gear 312 is integrally connected to a left end part of the shaft 311. The roller part 313 is provided peripherally around the rotation axis of the shaft 311 and comes into contact with the workpiece CM when feeding the workpiece CM. The feed roller 33 has a shaft 331, a gear 332 and a roller part 333. The shaft 331 is configured to be rotatable around a rotation axis extending in the left-right direction. The roller part 333 is provided peripherally around the rotation axis of the shaft 331 and comes into contact with the workpiece CM when feeding the workpiece CM. The roller parts 313, 333 are configured to transmit rotating forces of the feed rollers 31, 33 as driving force to the workpiece CM.

As shown in FIG. 10, a pulley 157 is connected to a right end part of the motor shaft 153 so as to rotate together with the motor shaft 153. A belt 201 is looped over the pulley 157. The belt 201 is looped over a pulley 211 of the cutter head 21. The rotating power (speed) of the motor 15 is appropriately changed via the pulley 157, the belt 201 and the pulley 211 and is transmitted to the cutter head 21.

The cutter head 21 is configured to be rotatable around a rotation axis extending in the left-right direction. Plane blades 213, 214 are provided extending in parallel to the rotation axis on a periphery of the cutter head 21. The plane blades 213, 214 are fastened to the cutter head 21 by a plurality of screw parts 215 in symmetrical positions with respect to the rotation axis of the cutter head 21. A pulley 211 is connected to a right end part of the cutter head 21 so as to rotate together with the cutter head 21. As described above, the cutter head 21 is rotated by the rotational power of the motor 15 which is transmitted via the pulley 157, the belt 201 and the pulley 211. The plane blades 213, 214 of the cutter head 21 plane the workpiece CM which is fed rearward from the front by the feed rollers 31, 33.

Next, the battery pack mounting unit 50 and the battery pack 60 are described with reference to FIGS. 8 and 11 to 14.

Each of the battery packs 60 has a nominal voltage of 18 volts and is used as a power source for the thickness planer 1. The battery pack 60 can also be used as a power source for power tools other than the thickness planer 1, including an electric drill, an electric driver, an electric wrench, an electric grinder, an electric circular saw, an electric reciprocating saw, an electric jigsaw, an electric hammer, an electric cutter, an electric chainsaw, an electric planer, an electric nailing machine, an electric hedge trimmer, an electric lawn clipper, an electric lawnmower, an electric bush cutter, an electric blower and an electric cleaner.

The battery pack 60 can be referred to as a battery package or an assembled battery. The battery pack 60 has an outer housing formed into a prescribed size and five lithium-ion battery cells which are housed within the outer housing and connected in series. The battery pack 60 is rechargeable and can be recharged with a charger (not shown) after used as a power source for the thickness planer 1 or other power tools. The battery pack 60 is a so-called slide-type battery pack and can be removably attached to the battery pack mounting unit 50 of the thickness planer 1 and the charger.

Figure 12:
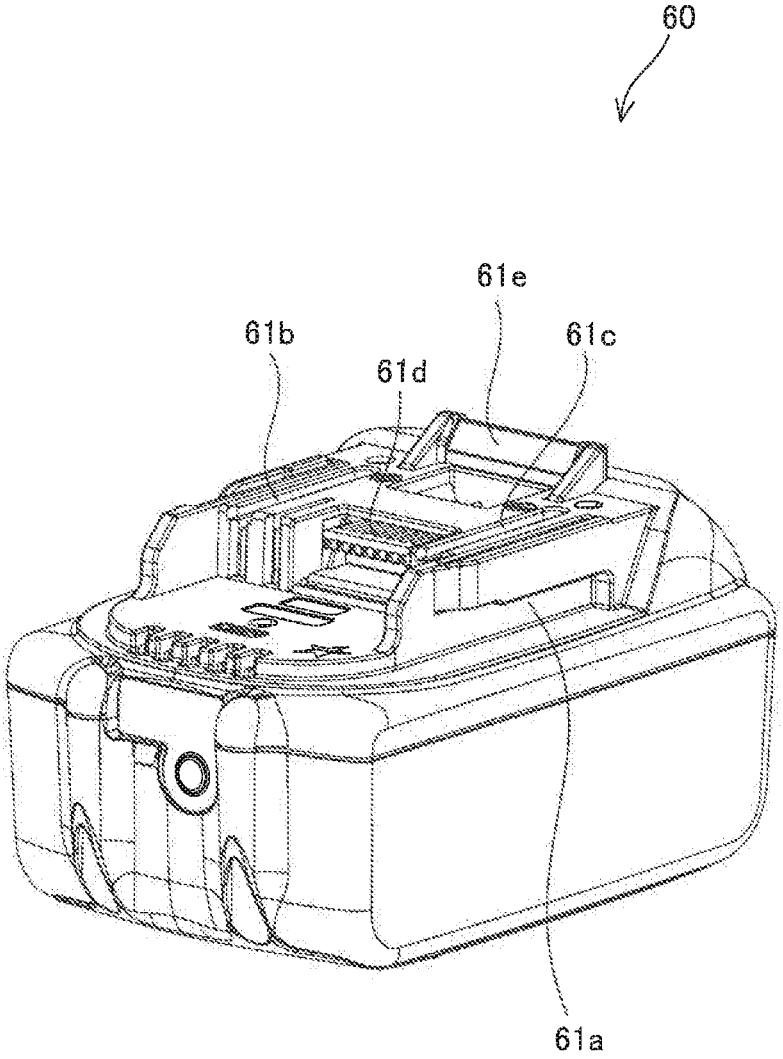
FIG. 12 shows a battery pack.
Figure 13:
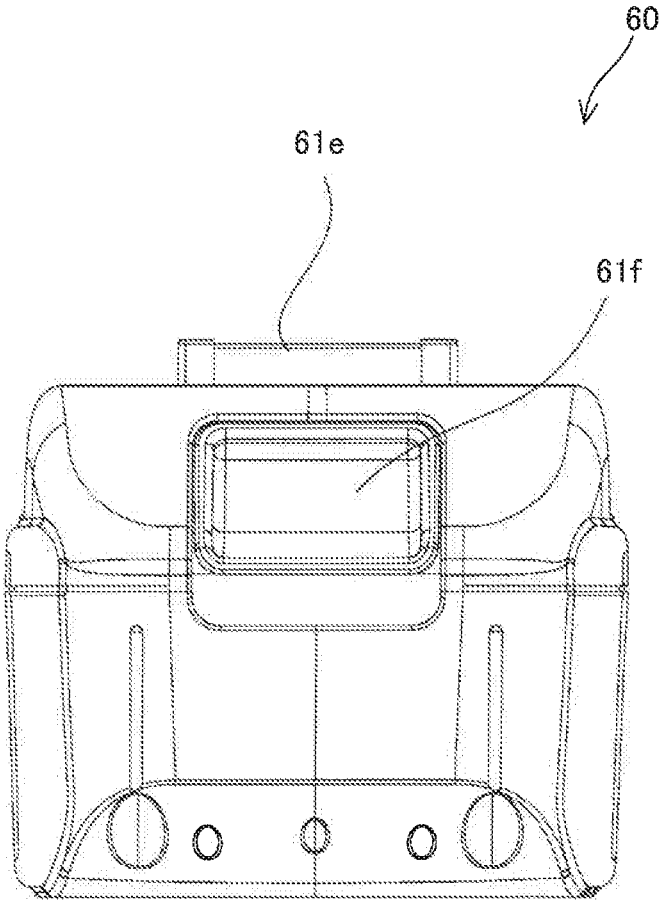
FIG. 13 is a rear view of the battery pack.

As shown in FIG. 12, a pair of left and right rail receiving parts 61*a* are provided in the battery pack 60. In the following description, the side of the battery pack 60 on which the rail receiving parts 61*a* are disposed is defined as an upper side of the battery pack 60 and the side opposite to the upper side of the battery pack 60 is defined as a lower side of the battery pack 60. A positive output terminal 61*b* and a negative output terminal 61*c* are arranged between the left and right rail receiving parts 61*a*. Between the positive output terminal 61*b* and the negative output terminal 61*c*, a connector part 61 is arranged to transmit/receive a control signal to/from the charger when the battery pack 60 is charged by the charger. Further, a lock member 61*e* is provided on an upper part of the battery pack 60 and a spring member (not shown) is arranged below the lock member 61*e* within the housing of the battery pack 60. This spring member biases the lock member 61*e* upward. An unlock button 61*f* is arranged on a back side of the battery pack 60 and the lock member 61*e* moves downward when the unlock button 61*f* (see FIG. 13) is pressed down.

Figure 11:
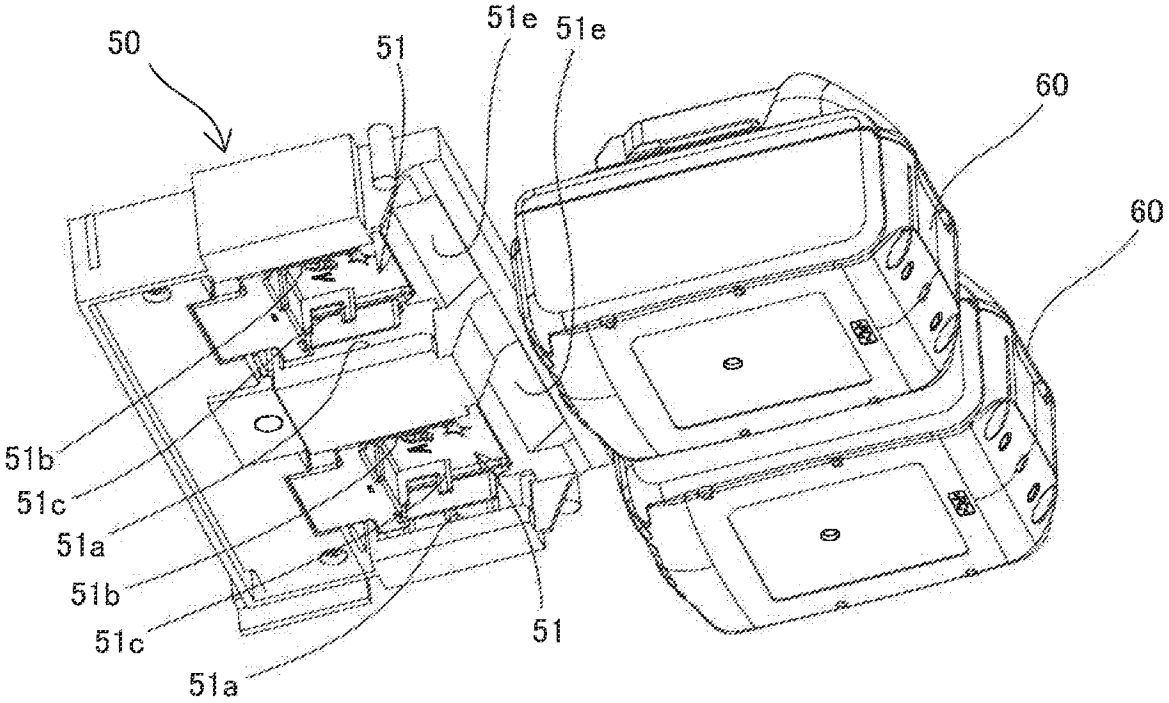
FIG. 11 shows the battery pack mounting unit.

As shown in FIG. 11, the battery pack mounting unit 50 has two mounting parts 51 having the same structure. The mounting parts 51 is electrically connected in series. Therefore, in the battery pack mounting unit 50, the battery packs 60 each having a nominal voltage of 18 volts can be connected in series. As described above, the thickness planer 1 has the rated voltage of 36 volts, and the thickness planer 1 can be driven by power supply from the battery pack mounting unit 50 to which the two battery packs 60 are attached. A pair of left and right rail parts 51*a* are provided in each of the mounting parts 51. A positive input terminal 51*b* and a negative input terminal 51*c* are arranged between the rail parts 51*a*. Further, a lock receiving hole 51*e* is provided in the mounting part 51 to be engaged with the lock member 61*e* of the battery pack 60.

In order to attach the battery pack 60 to the mounting part 51, the battery pack 60 is slid in a mounting direction with respect to the mounting part 51 such that the rail receiving part 61*a* is engaged with the rail part 51*a*. Further, in the following description, a direction along the rail part 51*a* of the battery pack mounting unit 50 is defined as a sliding direction. When the battery pack 60 is attached to the mounting part 51, the positive input terminal 51*b* and the negative input terminal 51*c* of the mounting part 51 are electrically connected to the positive output terminal 61*b* and the negative output terminal 61*c* of the battery pack 60, respectively. Further, when the battery pack 60 is attached to the mounting part 51, the lock member 61*e* is engaged with the lock receiving hole 51*e*, so that the battery pack 60 is fixed and locked so as to be unmovable in the sliding direction.

When the unlock button 61*f* of the battery pack 60 mounted to the mounting part 51 is pressed down by a user, the battery pack 60 is disengaged from the lock receiving hole 51*e* (the battery pack 60 is unlocked). In the unlocked state, the battery pack 60 is removed from the mounting part 51 by being slid in a removing direction with respect to the mounting part 51. In this manner, the battery pack 60 can be removably attached to the mounting part 51 of the battery pack mounting unit 50.

A mounting position of the battery pack mounting unit 50 in the thickness planer 1 of this embodiment is described in detail with reference to FIGS. 8 and 14.

The battery pack mounting unit 50 is arranged in the thickness planer 1 such that the battery pack mounting unit 50 and the battery pack 60 lie in a position avoiding the feeding area TA (see FIG. 2). In this embodiment, the battery pack mounting unit 50 and the battery pack 60 are arranged in the housing upper area HUA (see FIG. 3). Specifically, the battery pack mounting unit 50 is arranged above the main housing 100 and below the top cover 41. As shown in FIG. 14, in the thickness planer 1 of this embodiment, a length HL of the main housing 100 in the front-rear direction is shorter than a length FL of the main frame 30 in the front-rear direction and the main housing 100 is arranged in a front part of an area above the main frame 30. Thus, a free space exists in a rear part of the area above the main frame 30. Therefore, in this embodiment, the battery pack mounting unit 50 is fixed to a rear part of a lower surface of the top cover 41 by a plurality of screw parts. By provision of such a structure, when the body unit 10 is raised up to a highest position with respect to the table 43, the battery pack 60 and the battery pack mounting unit 50 are fitted in this free space and thus avoided from getting into contact with the body unit 10.

In this embodiment, the battery pack mounting unit 50 is mounted to the top cover 41 with the mounting part 51, the rail parts 51*a*, the positive input terminal 51*b* and the negative input terminal 51*c* facing downward. Specifically, the battery pack 60 is attached to the battery pack mounting unit 50 with the rail receiving part 61*a*, the positive output terminal 61*b* and the negative output terminal 61*c* facing upward.

As described above, the battery pack mounting unit 50 and the main housing 100 are connected to each other by an electric cord 52. In this embodiment, the electric cord 52 is extended from the battery pack mounting unit 50 in a direction twisted with respect to the direction in which the electric cord 52 is extended from the main housing 100. Specifically, as shown in FIG. 8, the electric cord 52 is extended from the battery pack mounting unit 50 in the left-right direction, while the electric cord 52 is extended from the main housing 100 in the front-rear direction. In other words, when viewed from above, the direction in which the electric cord 52 is extended from the battery pack mounting unit 50 is substantially perpendicular to the direction in which the electric cord 52 is extended from the main housing 100. By provision of such a structure, when the distance between the main housing 100 and the battery pack mounting unit 50 is shortened as the body unit 10 is raised with respect to the table 43, the surplus length of the electric cord 52 with respect to the distance between the main housing 100 and the battery pack mounting unit 50 escapes into a free space existing behind the main housing 100 and on the left side of the battery pack mounting unit 50 while being gently curved or bent. Thus, when the body unit 10 is raised, the electric cord 52 is avoided from being sharply curved or bent.

Figure 14:
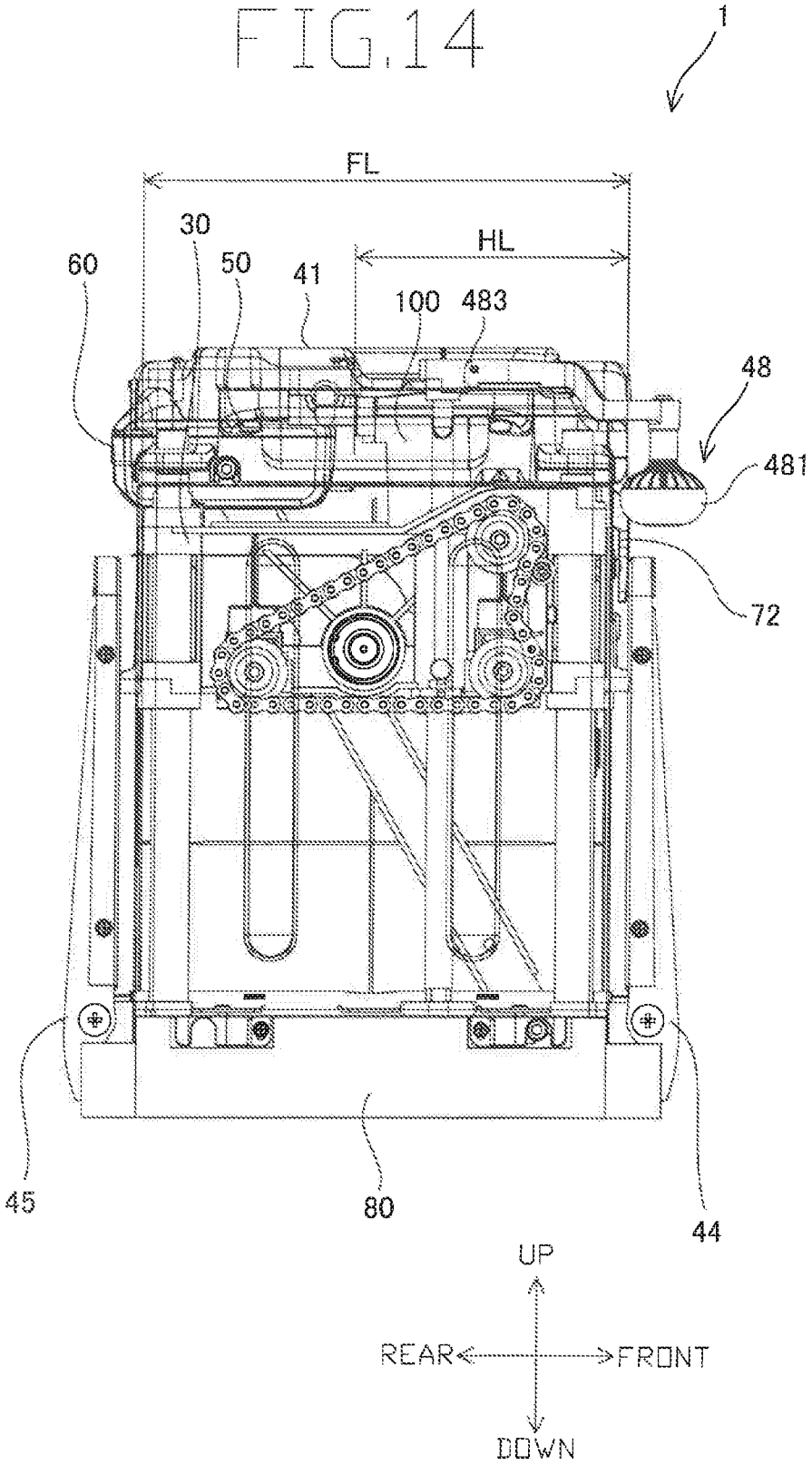
FIG. 14 is a partly cutaway left side view of the thickness planer when stored.

As shown in FIG. 14, when the thickness planer 1 is transported or stored, the front auxiliary table 44 and the rear auxiliary table 45 are turned upward around a pivot axis extending in the left-right direction so as to be folded upward from the front and rear ends of the table 43 (closed). The thickness planer 1 of this embodiment is configured such that rear end parts of the battery pack mounting unit 50 and the battery pack 60 are located forward (inward) of a rear end of the closed rear auxiliary table 45. Therefore, the battery pack mounting unit 50 and the battery pack 60 are avoided from getting into contact with external elements such as a user and surrounding equipment during transportation or storage of the thickness planer 1.

The lifting handle 48 is provided on an upper surface of the top cover 41 and supported by a pivot shaft 483. When the thickness planer 1 is used, as shown in FIG. 4, the lifting handle 48 is turned around the pivot shaft 483 such that an operation part 481 of the lifting handle 48 faces upward. On the other hand, when the thickness planer 1 is transported or stored, as shown in FIG. 14, the lifting handle 48 is turned around the pivot shaft 483 and folded such that the operation part 481 of the lifting handle 48 faces downward. When the lifting handle 48 is folded, an upper end of the lifting handle 48 is located below an upper end of the top cover 41. By provision of such a structure, the lifting handle 48 is avoided from getting into contact with external elements such as a user and surrounding equipment during transportation or storage of the thickness planer 1.

A structure for cooling the motor 15 and the controller 112 is now described with reference to FIGS. 15 and 16.

Figure 15:
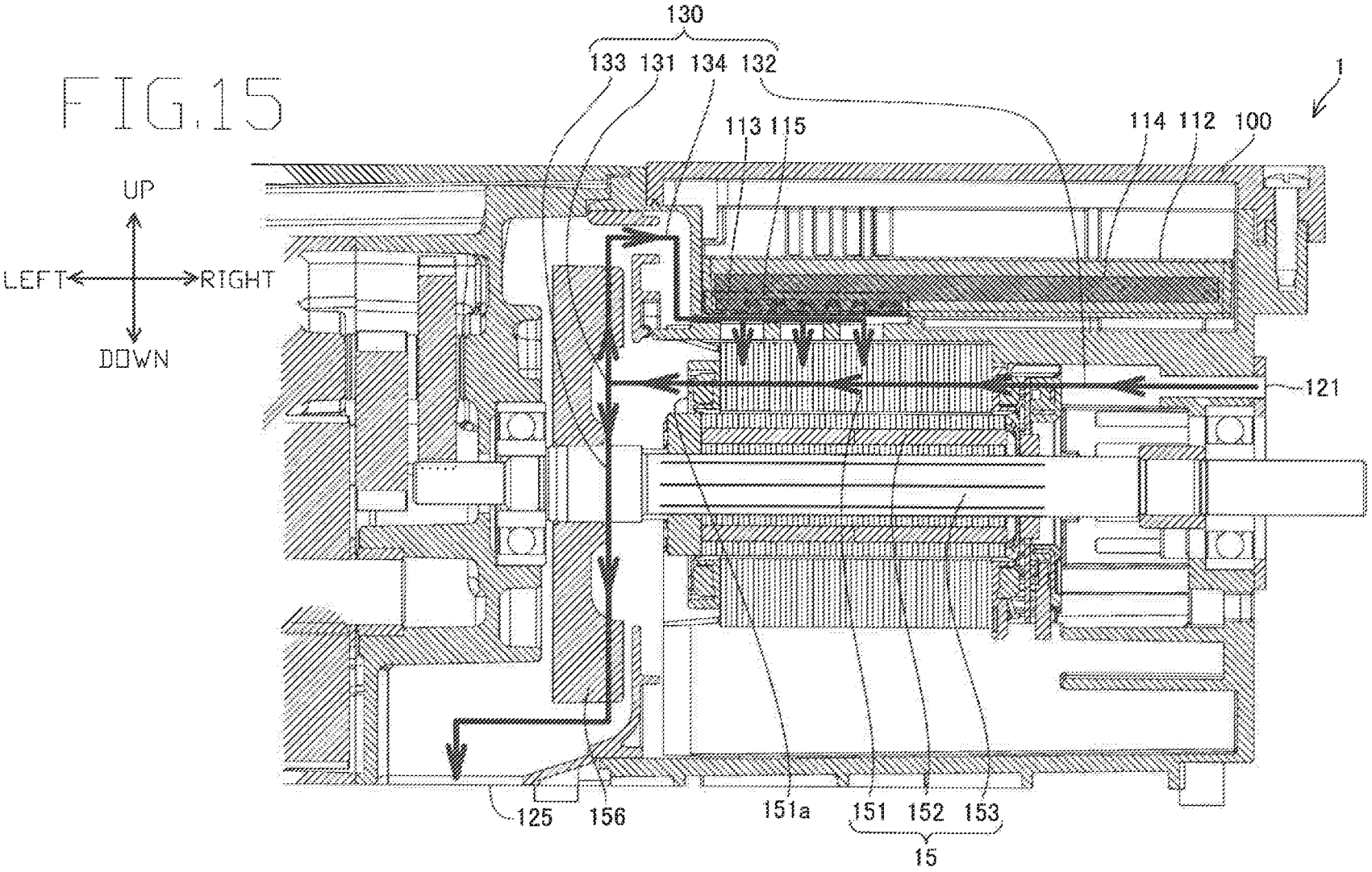
FIG. 15 is an explanatory drawing showing a section of a main housing.

FIG. 15 is an explanatory drawing showing a section of the main housing 100. In this embodiment, as shown in FIG. 15, the intake port 121 is formed in a right side of the main housing 100, and the outlet port 125 is formed in a bottom of the main housing 100. An air flow passage 130 and a fan 156 are provided within the main housing 100. The air flow passage 130 is configured such that air taken in from the intake port 121 flows therethrough toward the outlet port 125 via the motor 15, and the fan 156 is provided to generate flow of air from the intake port 121 to the outlet port 125 through the air flow passage 130. The detailed structure of this embodiment is now described.

In this embodiment, on the downstream side of the motor 15 in an air flowing direction, the air flow passage 130 has a branch part 131 for branching the air flow passage 130 into a plurality of branch flow passages. One of the branch flow passages of the air flow passage 130 on the upstream side of the branch part 131 is defined as a main air flow passage 132, and the other two on the downstream side of the branch part 131 are defined as a first branch air flow passage 133 and a second branch air flow passage 134, respectively. Thus, the air flow passage 130 has the main air flow passage 132, the first branch air flow passage 133 and the second branch air flow passage 134.

The motor 15 is arranged on the main air flow passage 132, and air taken in from the intake port 121 flows through a gap between the stator 151 and the rotor 152. In other words, the main air flow passage 132 is configured to include the gap between the stator 151 and the rotor 152.

The first branch air flow passage 133 is configured to communicate with the outlet port 125 via the fan 156.

The second branch air flow passage 134 is connected to the main air flow passage 132 on the upstream side of the branch part 131 via the fan 156 and configured to circulate part of air flowing through the air flow passage 130. Particularly, in this embodiment, the second branch air flow passage 134 is connected to the main air flow passage 132 on the upstream side of a downstream end 151*a* of the stator 151.

The controller 112 is arranged on the second branch air flow passage 134. The controller 112 arranged on the second branch air flow passage 134 is now described. In this embodiment, the control board 114 of the controller 112 has the transistor 115 as a switching element for PWM control of the motor 15, and the transistor 115 is disposed in a left lower region 113 of the controller 112. The left lower region 113 becomes hot by switching operation of the transistor 115 for PWM control of the motor 15 and is highly required to be cooled. Therefore, in this embodiment, this left lower region 113 in the controller 112 is arranged on the second branch air flow passage 134 and cooled by air flowing through the second branch air flow passage 134.

Figure 16:
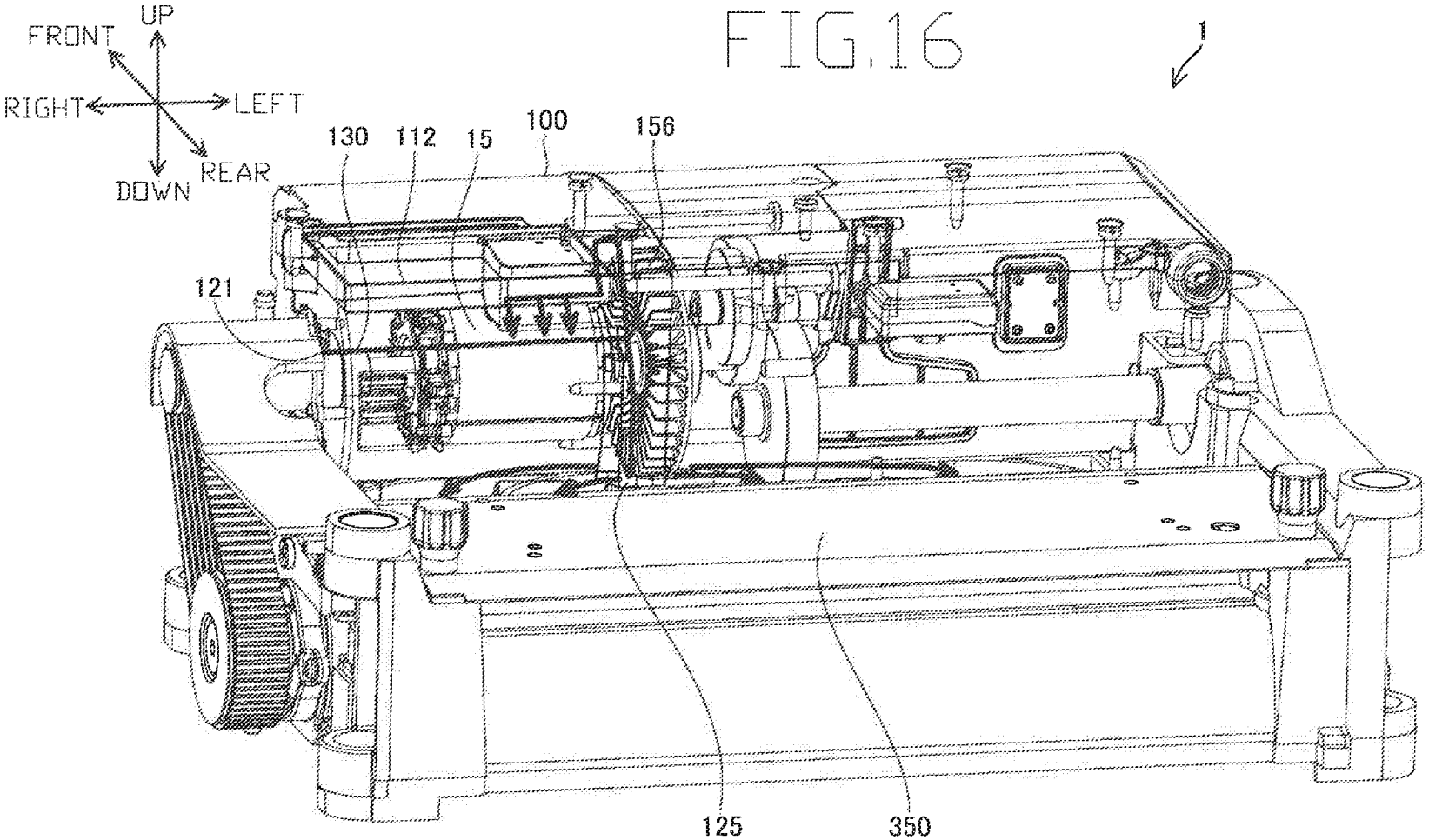
FIG. 16 is an explanatory drawing showing the surrounding vicinity of a chip cover and a chip discharge port.

Further, in this embodiment, as shown in FIG. 16, the chip cover 350 is provided in a region to which air is discharged from the outlet port 125 and prevents scattering of shavings. Shavings are collected within the chip cover 350 and discharged to the outside from the chip discharge port 145 by air discharged from the outlet port 125. Therefore, the outlet port 125 is configured to also serve as a jetting port for jetting air toward shavings generated when a workpiece is planed.

In this embodiment, as described above, within the main housing 100, the air flow passage 130 is provided which is configured such that air taken in from the intake port 121 flows therethrough toward the outlet port 125 via the motor 15, and the left lower region 113 of the controller 112 is arranged on the air flow passage 130. Therefore, according to this embodiment, the motor 15 and the left lower region 113 of the controller 112 are directly cooled by air taken in from the intake port 121. In other words, the left lower region 113 of the controller 112 is directly cooled by utilizing air for cooling the motor 15, so that the efficiency in cooling the controller 112 is further improved.

In this embodiment, the control board 114, which converts power supplied from the battery pack 60 into suitable power for driving of the motor, tends to become hot and is required to be cooled. In this embodiment, the controller 112 having the control board 114 is arranged on the air flow passage 130, so that the control board 114 is properly cooled. Therefore, reduction of the power converting capability of the control board 114 which may otherwise be caused by temperature rise of the control board 114 is suppressed.

Particularly, in this embodiment, the left lower region 113 of the controller 112 is arranged on the second branch air flow passage 134 of the air flow passage 130, so that the left lower region 113 is cooled by the circulating air. Therefore, compared with a structure in which air is not circulated, the time for which air per unit volume taken in from the intake port 121 is in contact with the left lower region 113 of the controller 112 is increased, so that the left lower region 113 of the controller 112 is efficiently and preponderantly cooled by air taken in from the intake port 121.

In this embodiment, the second branch air flow passage 134 is connected to the main air flow passage 132 on the upstream side of the downstream end 151*a* of the stator 151. Therefore, the stator 151 is cooled not only by the air taken in from the intake port 121 and flowing through the main air flow passage 132, but also by the air circulating from the second branch air flow passage 134 to the main air flow passage 132, so that the motor 15 is efficiently cooled.

In this embodiment, the main air flow passage 132 is configured to include the gap between the stator 151 and the rotor 152. Therefore, air flows through the gap, so that the motor 15 is efficiently cooled.

In this embodiment, the left lower region 113 in which the transistor 115 is disposed is arranged on the second branch air flow passage 134, so that the transistor 115 which tends to become hot by generating heat is efficiently and preponderantly cooled by air.

In this embodiment, the outlet port 125 is configured to also serve as a jetting port for jetting air toward shavings generated when a workpiece is planed, which eliminates the need to additionally provide a jetting port for jetting air toward shavings separately from the outlet port 125, so that the structure is simplified.

Second Embodiment

A thickness planer 1A according to a second embodiment of the present disclosure is now described with reference to FIG. 17. A main housing 100A and an air flow passage 130A of the thickness planer 1A of this embodiment are different in structure from the main housing 100 and the air flow passage 130 of the thickness planer 1 of the first embodiment. Structures which are identical to those of the first embodiment are not shown and described or briefly shown and described, and different structures are mainly described with reference to the drawing.

Figure 17:
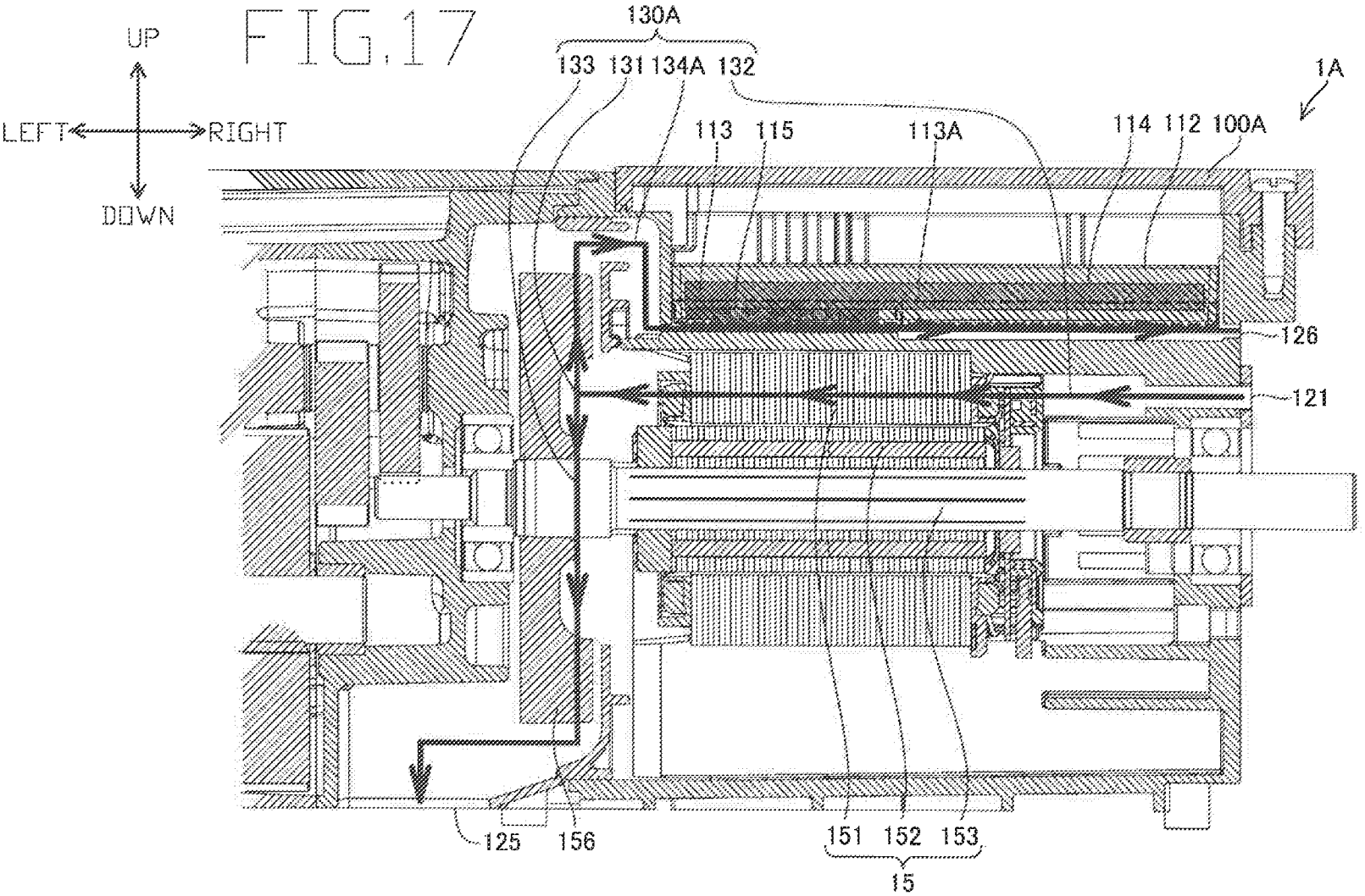
FIG. 17 is an explanatory drawing showing a section of a main housing according to a second embodiment.

FIG. 17 is an explanatory drawing showing a section of the main housing 100A of the second embodiment. In this embodiment, as shown in FIG. 17, an intake port 121 and an outlet port 126 are formed in a right side of the main housing 100A, and an outlet port 125 is formed in a bottom of the main housing 100A. An air flow passage 130A and the fan 156 are provided within the main housing 100A. The air flow passage 130A is configured such that air taken in from the intake port 121 flows therethrough toward the outlet port 125 or the outlet port 126 via the motor 15, and the fan 156 is provided to generate flow of air from the intake port 121 to the outlet port 125 or the outlet port 126 through the air flow passage 130A. The controller 112 is arranged on the air flow passage 130A. The detailed structure of this embodiment is now described.

In this embodiment, on the downstream side of the motor 15 in an air flowing direction, the air flow passage 130A has a branch part 131 for branching the air flow passage 130A into a plurality of branch flow passages. One of the branch flow passages of the air flow passage 130A on the upstream side of the branch part 131 is defined as a main air flow passage 132, and the other two on the downstream side of the branch part 131 is defined as a first branch air flow passage 133 and a second branch air flow passage 134A, respectively. Thus, the air flow passage 130A has the main air flow passage 132, the first branch air flow passage 133 and the second branch air flow passage 134A.

The motor 15 is arranged on the main air flow passage 132, and air taken in from the intake port 121 flows through a gap between the stator 151 and the rotor 152. In other words, the main air flow passage 132 is configured to include the gap between the stator 151 and the rotor 152.

The first branch air flow passage 133 is configured to communicate with the outlet port 125 via the fan 156.

The second branch air flow passage 134A is configured to communicate with the outlet port 126 via the fan 156.

The controller 112 is arranged on the second branch air flow passage 134A. The controller 112 arranged on the second branch air flow passage 134A is now described. In this embodiment, the control board 114 of the controller 112 has the transistor 115 as a switching element for PWM control of the motor 15, and the transistor 115 is disposed in the left lower region 113 of the controller 112. Further, semiconductor elements other than the transistor 115 and other electric circuit members are disposed in a right lower region 113A on the right side of the left lower region 113. The left lower region 113 having the transistor 115 becomes hot by switching operation of the transistor 115 for PWM control of the motor 15 and is highly required to be cooled. Further, the right lower region 113A having the semiconductor elements other than the transistor 115 and other electric circuit members generates heat though not so much as the left lower region 113 when the motor 15 is driven. Thus, the right lower region 113A is required to be cooled following the left lower region 113. Therefore, in this embodiment, the left lower region 113 which is highly required to be cooled and the right lower region 113A which is required to be cooled following the left lower region 113 are arranged on the second branch air flow passage 134 and cooled by air flowing through the second branch air flow passage 134A.

Like in the above-described first embodiment, the outlet port 125 is configured to also serve as a jetting port for jetting air toward shavings generated when a workpiece is planed.

In this embodiment, as described above, within the main housing 100A, the air flow passage 130A is provided which is configured such that air taken in from the intake port 121 flows therethrough toward the outlet port 125 via the motor 15, and the left lower region 113 and the right lower region 113A of the controller 112 are arranged on the air flow passage 130A. Therefore, according to this embodiment, the motor 15 and the left lower region 113 and the right lower region 113A of the controller 112 are directly cooled by air taken in from the intake port 121. In other words, the left lower region 113 and the right lower region 113A of the controller 112 are directly cooled by utilizing air for cooling the motor 15.

Particularly, in this embodiment, the air flow passage 130A has the main air flow passage 132 which communicates with the intake port 121, the first branch air flow passage 133 which is branched from the main air flow passage 132 and communicates with the outlet port 125, the second branch air flow passage 134 which is branched from the main air flow passage 132 and communicates with the outlet port 126. Further, the motor 15 is arranged on the main air flow passage 132, and the left lower region 113 and the right lower region 113A of the controller 112 are arranged on the second branch air flow passage 134A. Therefore, according to this embodiment, air taken into the main air flow passage 132 from the intake port 121 flows through the first and second branch air flow passages 133, 134 and is discharged from the two outlet ports 125, 126, so that the motor 15 and the left lower region 113 and the right lower region 113A of the controller 112 are directly cooled, while a load applied on the fan 156 by discharge of air is reduced compared with a structure having only one outlet port.

In this embodiment, the left lower region 113 having the transistor 115 is arranged on the second branch air flow passage 134A, so that the transistor 115 which tends to become hot by generating heat is efficiently and preponderantly cooled by air. Further, in this embodiment, the right lower region 113A is arranged on the second branch air flow passage 134A, so that the right lower region 113A which is required to be cooled following the left lower region 113 is efficiently and preponderantly cooled by air.

In this embodiment, the main air flow passage 132 is configured to include the gap between the stator 151 and the rotor 152. Therefore, air flows through the gap, so that the motor 15 is efficiently cooled.

In this embodiment, like in the above-described first embodiment, the outlet port 125 is configured to also serve as a jetting port for jetting air toward shavings generated when a workpiece is planed, which eliminates the need to additionally provide a jetting port for jetting air toward shavings separately from the outlet port 125, so that the structure is simplified.

Third Embodiment

A thickness planer 1B according to a third embodiment of the present disclosure is now described with reference to FIG. 18. A main housing 100B and an air flow passage 130B of the thickness planer 1B of this embodiment are different in structure from the main housing 100 and the air flow passage 130 of the thickness planer 1 of the first embodiment. Structures which are identical to those of the first embodiment are not shown and described or briefly shown and described, and different structures are mainly described with reference to the drawing.

Figure 18:
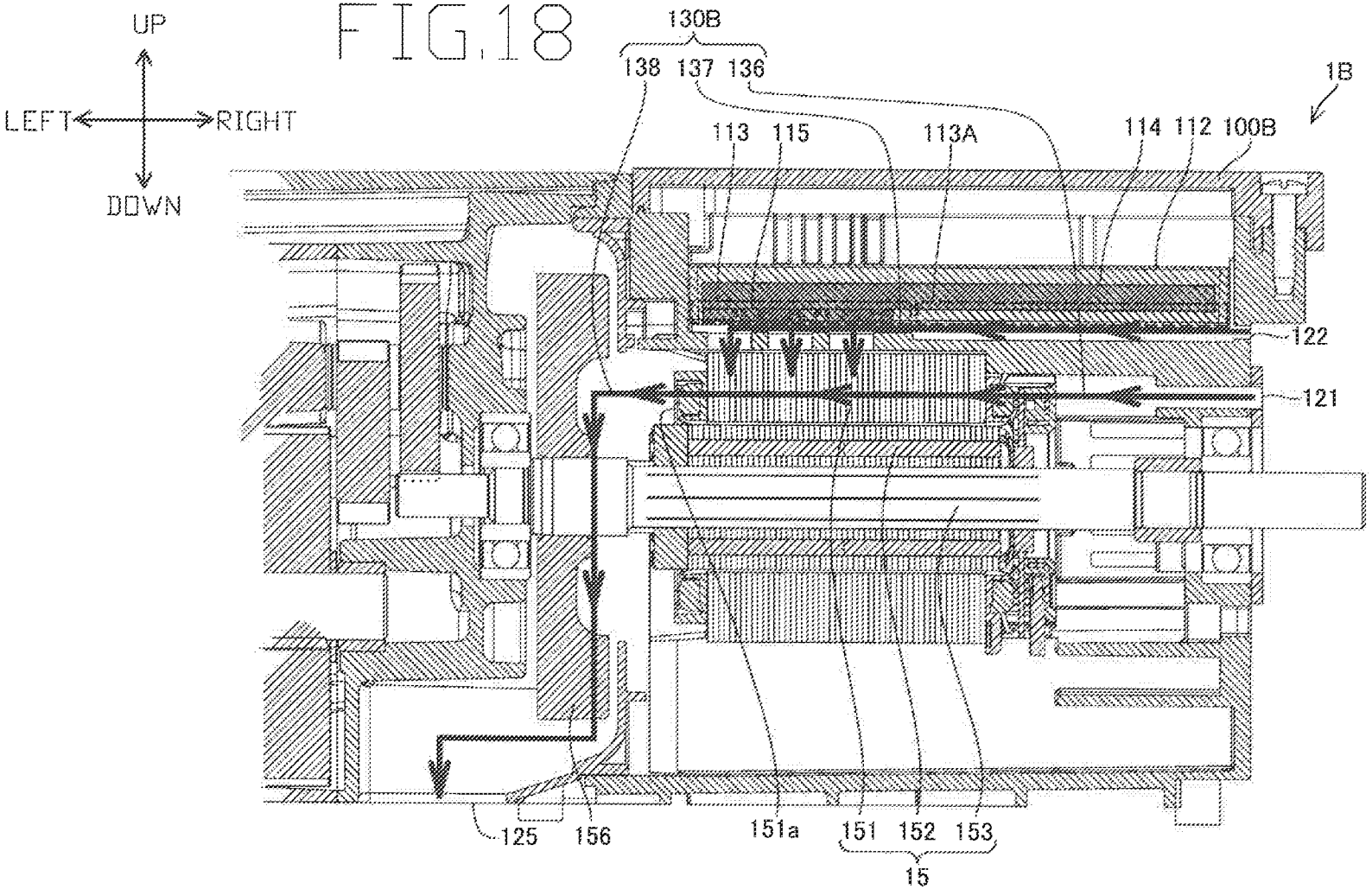
FIG. 18 is an explanatory drawing showing a section of a main housing according to a third embodiment.

FIG. 18 is an explanatory drawing showing a section of the main housing 100B of the third embodiment. In this embodiment, as shown in FIG. 18, an intake port 121 and an intake port 122 are formed in a right side of the main housing 100B, and an outlet port 125 is formed in a bottom of the main housing 100B. An air flow passage 130B and the fan 156 are provided within the main housing 100B. The air flow passage 130B is configured such that air taken in from the intake port 121 or the intake port 122 flows therethrough toward the outlet port 125 via the motor 15, and the fan 156 is provided to generate flow of air from the intake port 121 or the intake port 122 to the outlet port 125 through the air flow passage 130B. The controller 112 is arranged on the air flow passage 130B. The detailed structure of this embodiment is now described.

In this embodiment, the air flow passage 130B has a first air flow passage 136 which is configured such that air taken in from the intake port 121 flows therethrough, and a second air flow passage 137 which is configured such that air taken in from the intake port 122 flows therethrough. Further, the air flow passage 130B has a merged air flow passage 138 to which the first air flow passage 136 and the second air flow passage 137 merge such that the air taken in from the intake port 121 and the air taken in from the intake port 122 flow therethrough toward the outlet port 125.

The motor 15 is arranged on the first air flow passage 136, and air taken in from the intake port 121 flows through a gap between the stator 151 and the rotor 152. In other words, the first air flow passage 136 is configured to include the gap between the stator 151 and the rotor 152.

The controller 112 is arranged on the second air flow passage 137. The controller 112 arranged on the second air flow passage 137 is now described. In this embodiment, the control board 114 of the controller 112 has the transistor 115 as a switching element for PWM control of the motor 15, and the transistor 115 is disposed in the left lower region 113 of the controller 112. Further, semiconductor elements other than the transistor 115 and other electric circuit members are disposed in a right lower region 113A on the right side of the left lower region 113. The left lower region 113 having the transistor 115 becomes hot by switching operation of the transistor 115 for PWM control of the motor 15 and is highly required to be cooled. Further, the right lower region 113A having the semiconductor elements other than the transistor 115 and other electric circuit members generates heat though not so much as the left lower region 113 when the motor 15 is driven, and is thus required to be cooled following the left lower region 113. Therefore, in this embodiment, the left lower region 113 which is highly required to be cooled and the right lower region 113A which is required to be cooled following the left lower region 113 are arranged on the second air flow passage 137 and cooled by air flowing through the second air flow passage 137.

The merged air flow passage 138 is configured to communicate with the outlet port 125 via the fan 156. In this embodiment, the first air flow passage 136 and the second air flow passage 137 merge on the upstream side of the downstream end 151*a* of the stator 151 in the air flowing direction.

Like in the above-described first and second embodiments, the outlet port 125 is configured to also serve as a jetting port for jetting air toward shavings generated when a workpiece is planed.

In this embodiment, as described above, within the main housing 100B, the air flow passage 130B is provided which is configured such that air taken in from the intake port 121 flows therethrough toward the outlet port 125 via the motor 15, and the left lower region 113 and the right lower region 113A of the controller 112 are arranged on the air flow passage 130B. Therefore, according to this embodiment, the motor 15 and the left and right lower regions 113, 113A of the controller 112 are directly cooled by air taken in from the intake port 121. In other words, the left lower region 113 and the right lower region 113A of the controller 112 are directly cooled by utilizing air for cooling the motor 15.

Particularly, in this embodiment, the air flow passage 130B has the first air flow passage 136 which is configured such that air taken in from the intake port 121 flows therethrough, and the second air flow passage 137 which is configured such that air taken in from the intake port 122 flows therethrough. Further, the motor 15 is arranged on the first air flow passage 136, and the left lower region 113 and the right lower region 113A of the controller 112 are arranged on the second air flow passage 137. Therefore, according to this embodiment, air is taken in from the two intake ports 121 and 122, so that a load applied on the fan 156 by intake of air is reduced compared with a structure having only one intake port. Further, the motor 15 and the left and right lower regions 113, 113A of the controller 112 are cooled by air taken in from the different intake ports, respectively, so that the motor 15 and the left and right lower regions 113, 113A are efficiently cooled.

In this embodiment, the left lower region 113 in which the transistor 115 is disposed is arranged on the second air flow passage 137, so that the transistor 115 which tends to become hot by generating heat is efficiently and preponderantly cooled by air. Further, in this embodiment, the right lower region 113A is arranged on the second air flow passage 137, so that the right lower region 113A which is required to be cooled following the left lower region 113 is efficiently and preponderantly cooled by air.

In this embodiment, the first air flow passage 136 is configured to include the gap between the stator 151 and the rotor 152. Therefore, air flows through the gap, so that the motor 15 is efficiently cooled.

In this embodiment, like in the above-described first and second embodiments, the outlet port 125 is configured to also serve as a jetting port for jetting air toward shavings generated when a workpiece is planed, which eliminates the need to additionally provide a jetting port for jetting air toward shavings separately from the outlet port 125, so that the structure is simplified.

In this embodiment, the first air flow passage 136 and the second air flow passage 137 merge on the upstream side of the downstream end 151*a* of the stator 151 in the air flowing direction, so that air flowing through the second air flow passage 137 passes through part of the stator 151. Therefore, the stator 151 is cooled not only by the air taken in from the intake port 121 and flowing through the first air flow passage 136, but by the air flowing through the second air flow passage 137, so that the motor 15 is efficiently cooled.

(Other Aspects)

The above-described embodiments are a mere example of the disclosure and a thickness planer according to the present disclosure is not limited to the structures of the thickness planers 1, 1A, 1B of the above-described embodiments. For example, the following modifications may be made. One or more of these modifications may be adopted in combination with the thickness planers 1, 1A, 1B of the above-described embodiments or the claimed disclosure.

In the above-described first embodiment, a downstream end of the second branch air flow passage 134 is branched into a plurality of flow passages, but it need not be branched.

In the above-described first embodiment, all of the flow passages branched from the downstream end of the second branch air flow passage 134 are connected to the upstream side of the downstream end 151*a* of the stator 151, but only part of the flow passages may be connected to the upstream side of the downstream end 151*a* of the stator 151.

In the above-described first embodiment, the second branch air flow passage 134 is connected to the main air flow passage 132 on the upstream side of the downstream end 151*a* of the stator 151, but it may be connected to the main air flow passage 132 on the downstream side of the downstream end 151*a* of the stator 151.

In the above-described third embodiment, a downstream end of the second branch air flow passage 137 is branched into a plurality of flow passages, but it need not be branched.

In the above-described third embodiment, the first air flow passage 136 and the second air flow passage 137 are configured to merge on the upstream side of the downstream end 151*a* of the stator 151 in the air flowing direction, but they may be configured to merge on the downstream side of the downstream end 151*a* of the stator 151 in the air flowing direction.

In each of the above-described embodiments, a region which is highly or less highly required to be cooled is arranged on the air flow passage 130. Specifically, in the first embodiment, the left lower region 113 of the controller 112 is arranged on the air flow passage 130; in the second embodiment, the left lower region 113 and the right lower region 113A of the controller 112 are arranged on the air flow passage 130A; and in the third embodiment, the left lower region 113 and the right lower region 113A of the controller 112 are arranged on the air flow passage 130B. Thus, in each of the above-described embodiments, part of the region of the controller 112 is arranged on the air flow passage. However, the whole region of the controller 112 may be arranged on the air flow passage. For example, the air flow passage may be provided such that air passes through all of the upper, lower, right and left sides of the controller 112. By provision of such a structure, the efficiency in cooling the controller 112 is further improved. Consequently, in order to efficiently cool the controller 112, at least part of the region of the controller 112 may just be arranged on the air flow passage.

In each of the above-described embodiments, a brushless motor is adopted as the motor 15, and a controller having a control board for performing PWM control of the brushless motor is adopted as the controller 112. However, other kinds of motor may be adopted as the motor 15, and a controller having a control board for controlling the motor of other kind may be adopted as the controller 112. Specifically, for example, a DC motor with a brush, a three-phase induction motor and a single-phase induction motor may be adopted as the motor 15, and various kinds of controllers having respective control boards for controlling these motors of various kinds may be adopted as the controller 112.

In each of the above-described embodiments, the outlet port 125 is configured to also serve as a jetting port for jetting air toward shavings generated when a workpiece is planed, but it need not be configured to do so.

In each of the above-described embodiments, the air flow passage 130, 130A, 130B is configured to include the gap between the stator 151 and the rotor 152, but it need not be configured to include the gap. Specifically, it may be configured such that air flowing through the air flow passage 130, 130A, 130B passes around a periphery of the motor 15.

(Correspondences)

Correspondences between the features of the above-described embodiments and the features of the present invention are as follows. The thickness planer 1, 1A, 1B is an example embodiment that corresponds to the "thickness planer" according to the present invention. The main housing 100, 100A, 100B is an example embodiment that corresponds to the "housing" according to the present invention. The intake port 121, 122 is an example embodiment that corresponds to the "intake port" according to the present invention. The intake port 121 is an example embodiment that corresponds to the "first intake port" according to the present invention. The intake port 122 is an example embodiment that corresponds to the "second intake port" according to the present invention. The outlet port 125, 126 is an example embodiment that corresponds to the "outlet port" according to the present invention. The outlet port 125 is an example embodiment that corresponds to the "first outlet port" according to the present invention. The outlet port 126 is an example embodiment that corresponds to the "second outlet port" according to the present invention. The motor 15 is an example embodiment that corresponds to the "motor" according to the present invention. The stator 151 is an example embodiment that corresponds to the "stator" according to the present invention. The downstream end 151*a* is an example embodiment that corresponds to the "downstream end" according to the present invention. The rotor 152 is an example embodiment that corresponds to the "rotor" according to the present invention. The fan 156 is an example embodiment that corresponds to the "fan" according to the present invention. The controller 112 is an example embodiment that corresponds to the "controller" according to the present invention. The left lower region 113, the right lower region 113A and the whole region of the controller are an example embodiment that corresponds to the "particular region" according to the present invention. The control board 114 is an example embodiment that corresponds to the "control board" according to the present invention. The transistor 115 is an example embodiment that corresponds to the "transistor" according to the present invention. The air flow passage 130, 130A, 130B is an example embodiment that corresponds to the "air flow passage" according to the present invention. The branch part 131 is an example embodiment that corresponds to the "branch part" according to the present invention. The main air flow passage 132 is an example embodiment that corresponds to the "main air flow passage" according to the present invention. The first branch air flow passage 133 is an example embodiment that corresponds to the "first branch air flow passage" according to the present invention. The second branch air flow passage 134, 134A is an example embodiment that corresponds to the "second branch air flow passage" according to the present invention. The first air flow passage 136 is an example embodiment that corresponds to the "first air flow passage" according to the present invention. The second air flow passage 137 is an example embodiment that corresponds to the "second air flow passage" according to the present invention. The merged air flow passage 138 is an example embodiment that corresponds to the "merged air flow passage" according to the present invention.

DESCRIPTION OF THE NUMERALS

1, 1A, 1B: thickness planer, 10: body unit, 15: motor, 19: residual capacity display part, 21: cutter block, 30: main frame, 31, 33: feed roller, 41: top cover, 43: table, 44: front auxiliary table, 45: rear auxiliary table, 46: left side cover, 47: right side cover, 48: lifting handle, 50: battery pack mounting unit, 51: mounting part, 51*a*: rail part, 51*b*: positive input terminal, 51*c*: negative input terminal, 51*e*: lock receiving hole, 52: electric cord, 60: battery pack, 61*a*: rail receiving part, 61*b*: positive output terminal, 61*c*: negative output terminal, 61*d*: connector part, 61*e*: lock member, 61*f*: unlock button, 71: main switch, 72: lever switch, 80: base, 100, 100A, 100B: main housing, 110: first housing, 112: controller, 113: left lower region, 113A: right lower region, 114: control board, 115: transistor, 118: right end wall part, 121: intake port, 122: intake port, 125: outlet port, 126: outlet port, 130: air flow passage, 130A: air flow passage, 130B: air flow passage, 131: branch part, 132: main air flow passage, 133: first branch air flow passage, 134: second branch air flow passage, 134A: second branch air flow passage, 136: first air flow passage, 137: second air flow passage, 138: merged air flow passage, 145: chip discharge port, 151: stator, 151*a*: downstream end, 152: rotor, 153: motor shaft, 154, 155: bearing, 156: fan, 157: pulley, 160: second housing, 161, 162, 163: gear, 164: drive shaft, 166: gear, 180: third housing, 191, 192: residual capacity gauge, 201: belt, 211: pulley, 213, 214: planer blade, 215: screw part, 301: chain, 311: shaft, 312: gear, 313: roller part, 331: shaft, 332: gear, 333: roller part, 341, 342, 343, 344: slide part, 345, 346: lifting screw hole part, 350: chip cover, 351: screw part, 352: screw part, 411, 412, 413, 414: column, 415, 416, 417, 418: screw part, 420: escape part, 431: placing surface, 441: placing surface, 451: placing surface, 481: operation part, 483: pivot shaft, 485, 486: lifting screw shaft, CA: cutting area, TA: feeding area, CM: workpiece

What is claimed is:

1. A thickness planer configured to plane a workpiece by a driving force of a motor, the thickness planer comprising:
- a housing;
- a controller having a control board configured to control driving of the motor;
- a cutting head configured to plane the workpiece;
- at least one intake port in the housing;
- at least one outlet port in the housing;
- an air flow passage that is in the housing and configured such that air taken into the housing from the at least one intake port flows through the air flow passage to the at least one outlet port via the motor; and
- a fan that is configured to generate flow of air from the at least one intake port to the at least one outlet port through the air flow passage, wherein:
- the motor is housed in the housing;
- a region of the controller is on the air flow passage;
- the air flow passage has a branch part for branching the air flow passage into a plurality of branch flow passages, on a downstream side of the motor in an air flowing direction; and
- when a portion of the air flow passage on an upstream side of the branch part is defined as a main air flow passage, and the plurality of branch flow passages on a downstream side of the branch part include a first branch air flow passage and a second branch air flow passage;
- the first branch air flow passage is configured to communicate with the at least one outlet port;
- the second branch air flow passage is configured to circulate a part of the air flowing through the main air flow passage; and
- the region of the controller is on the second branch air flow passage.

2. The thickness planer as defined in claim 1, wherein the at least one outlet port includes a first outlet port that is configured to jet air toward shavings generated when the workpiece is planed.

3. The thickness planer as defined in claim 2, wherein:
- the motor has a stator and a rotor, and
- the air flow passage is configured to include a gap between the stator and the rotor.

4. The thickness planer as defined in claim 3, wherein:
- a downstream end of the second branch air flow passage is connected to the main air flow passage along an axial length of the stator.

5. The thickness planer as defined in claim 4, wherein:
- the control board has a transistor configured to switch a current flowing to the motor, and
- the region of the controller includes a region in which the transistor is located.

6. The thickness planer as defined in claim 5, further comprising:
- a battery pack mounting unit to which a battery pack for supplying power to the motor is attachable, wherein:
- the control board is configured to convert power supplied from the battery pack into suitable power for driving of the motor and supply the suitable power to the motor.

7. The thickness planer as defined in claim 1, wherein:
- the motor has a stator and a rotor, and
- the air flow passage is configured to include a gap between the stator and the rotor.

8. The thickness planer as defined in claim 1, wherein:
- the motor has a stator and a rotor, and
- a downstream end of the second branch air flow passage is connected to the main air flow passage along an axial length of the stator.

9. The thickness planer as defined in claim 1, wherein:
- the control board has a transistor configured to switch a current flowing to the motor, and
- the region of the controller includes a region in which the transistor is located.

10. The thickness planer as defined in claim 1, further comprising:
- a battery pack mounting unit to which a battery pack for supplying power to the motor is attachable, wherein:
- the control board is configured to convert power supplied from the battery pack into suitable power for driving of the motor and supply the suitable power to the motor.

* * * * *